US011067316B2

(12) United States Patent
Shenhav et al.

(10) Patent No.: US 11,067,316 B2
(45) Date of Patent: Jul. 20, 2021

(54) COOLING WITH ANTI-STOKES FLUORESCENCE

(71) Applicant: SOLCOLD, Herzliya (IL)

(72) Inventors: Yaron Shenhav, Herzliya (IL); Gadi Grottas, Tel Aviv (IL)

(73) Assignee: SOLCOLD

( * ) Notice: Subject to any disclaimer, the term of this patent is extended or adjusted under 35 U.S.C. 154(b) by 218 days.

(21) Appl. No.: 16/318,137

(22) PCT Filed: Jul. 29, 2017

(86) PCT No.: PCT/IL2017/050843
§ 371 (c)(1),
(2) Date: Jan. 16, 2019

(87) PCT Pub. No.: WO2018/020503
PCT Pub. Date: Feb. 1, 2018

(65) Prior Publication Data

US 2019/0154316 A1 May 23, 2019

Related U.S. Application Data

(60) Provisional application No. 62/368,177, filed on Jul. 29, 2016.

(51) Int. Cl.
*F25B 23/00* (2006.01)
*F25D 31/00* (2006.01)

(52) U.S. Cl.
CPC ..... *F25B 23/003* (2013.01); *F25D 31/00* (2013.01); *F25D 2400/26* (2013.01)

(58) Field of Classification Search
CPC .. F25B 23/003; F25B 23/00; F25D 2400/026; F25D 2400/26; H01S 3/1062; H01S 3/04;
(Continued)

(56) References Cited

U.S. PATENT DOCUMENTS 5,447,032 A * 9/1995 Epstein ..... F25B 23/003 62/3.1
6,378,321 B1 * 4/2002 Epstein ..... F25B 23/00 62/264

(Continued)

FOREIGN PATENT DOCUMENTS

CN 2408572 Y * 11/2000
CN 2408572 Y 11/2000

(Continued)

OTHER PUBLICATIONS

Wikipedia"Kevlar" Feb. 26, 2015 retrieved from https://en.wikipedia.org/w/index.php?title=Kevlar&oldid648882245 on Jan. 16, 2019.

(Continued)

*Primary Examiner* — Emmanuel E Duke
(74) *Attorney, Agent, or Firm* — Clark Hill PLC; James R. Foley

(57) ABSTRACT

A double or multi-layer apparatus or device for optical anti-Stokes cooling of object surfaces. The apparatus comprises at least one bottom layer, which is configured to respond in anti-Stokes fluorescence upon absorption of electromagnetic radiation and at least one top layer, which is overlaid on the bottom layer and configured to filter the electromagnetic radiation and transmit selected spectral band of the electromagnetic radiation to the bottom layer. The active cooling does not depend on the coherent nature of the radiation, which enables the usage of incoherent solar radiation as the active cooling input power source. The cooling technology of the invention is suitable for small and large scales and practically for any object with surface on which the layer substance can be applied or overlaid, e.g., roof, wall, car, ship, tent, clothing, etc.

20 Claims, 14 Drawing Sheets

(58) Field of Classification Search
CPC ... H01S 3/02461; H01S 3/0408; H01L 23/34; G03F 7/70891; G03F 7/70958
See application file for complete search history.

(56) References Cited

U.S. PATENT DOCUMENTS

| | | | | |
|---|---|---|---|---|
| 6,841,092 | B2 | 1/2005 | Paeschke | |
| 8,794,010 | B2 | 8/2014 | Williams et al. | |
| 10,018,379 | B2 | 7/2018 | Shenhav | |
| 2003/0210448 | A1 | 11/2003 | Buchwald | |
| 2010/0139749 | A1 | 6/2010 | Mapel | |
| 2012/0147906 | A1 | 6/2012 | Williams | |
| 2012/0167983 | A1* | 7/2012 | Cho | H01L 31/055 136/257 |

FOREIGN PATENT DOCUMENTS

| | | | |
|---|---|---|---|
| CN | 1300927 | A | 6/2001 |
| CN | 102511084 | A | 6/2012 |
| CN | 102976612 | A | 3/2013 |
| CN | 104567088 | A | 4/2015 |
| WO | WO2015/157521 | | 10/2015 |

OTHER PUBLICATIONS

Galina Nemova et al., Laser cooling of solids: latest achievements and prospects Proc. of SPIE vol. 10550 Nov. 19, 2018.
Galina Nemova et al.,Laser cooling of solids; Rep. Prog. Phys. 73 (2010) 086501 (20pp).
Epstein et al., "Observation of laser induced fluorescent cooling of a solid". Nature 377, 500-503 (1995).
Melgaard et al., "Solid-state optical regfrigiration to sub-100 Kelvin regine", Nature scientific reports (2016).
Patterson et al., "Measurement of solid-state optical refrigeration by two-band differential luminescence thermometry" Journal Opt. Sci. Am. B 27, 611 (2010).
Dehui Li et al., "Laser cooling of CdS nanobelts: Thickness matters" Optics Express vol. 21, Issue 16, pp. 19302-19310 (2013).
Jun Zhang et al.,"Laser cooling of a semiconductor by 40 Kelvin". Nature 493, 504-508 (24 Jan. 2013).
Tao Gao and Taihong Wang, "Catalyst-Assisted Vapor-Liquid-Solid Growth of Single-Crystal CdS Nanobelts and Their Luminescence Properties". J. Phys. Chem. B, 2004, 108 (52), pp. 20045-20049 (Nov. 24, 2004).
Fontenot et al.," Measuring the anti-Stokes luminescence of CdSe/ZnS quantum dots for laser cooling applications". Proc. Of SPIE 9821, 982103 (2016).

* cited by examiner

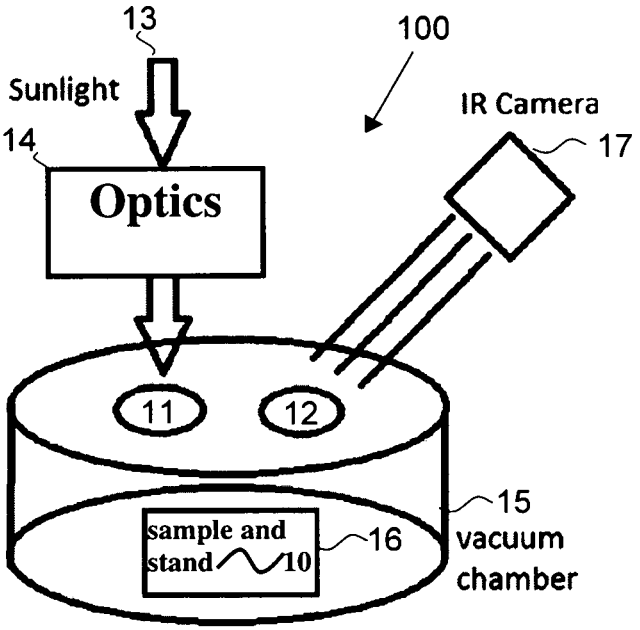
Fig. 8
*The experimental system of temperature measurement with IR camera*
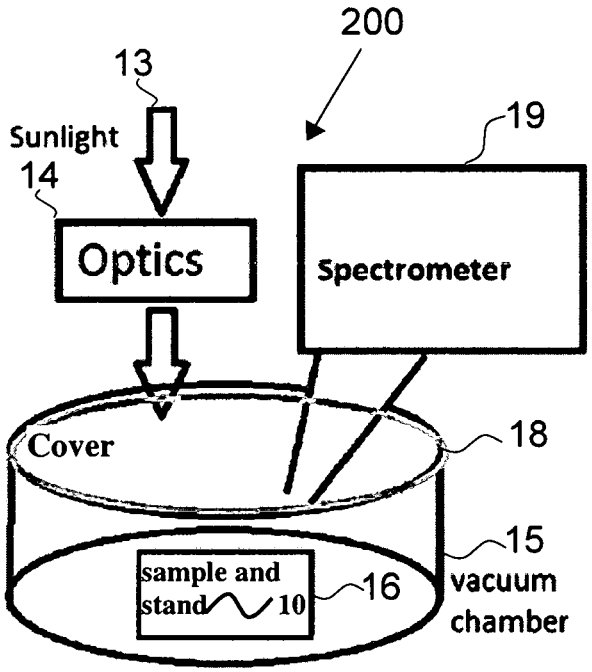
Fig. 9 *The spectrometer system*

*Intensity of filtered sunlight from reference glass and ZBLAN*

*Normalized intensity by normalized wavelength of sunlight simulator and trough the filter*

COOLING WITH ANTI-STOKES FLUORESCENCE

DETAILS OF RELATED APPLICATIONS

This is a national stage application under 35 U.S.C. § 371 of PCT /IL2017/050843 filed on 29 Jul. 2017 and subsequently published as WO 2018/020503 on Feb. 1, 2018, said PCT application claiming the benefit of U.S. provisional application 62/368,117 filed on Jul. 29, 2016 according to 35 U.S.C. § 119 (e); each of which earlier applications is hereby incorporated by reference in its entirety.

TECHNICAL FIELD

The present invention pertains to cooling using anti-stokes fluorescence. More particularly, the present invention pertains to cooling technology that uses absorption of incoherent non-monochromatic electromagnetic/solar radiation and anti-stokes fluorescence.

BACKGROUND

Laser cooling of solids is a phenomenon in which interaction with radiation is causing effective cooling in solid materials. The idea was proposed as early as 1929 by Pringsheim. It wasn't until 1995 that laser cooling of solids was achieved by Epstein et al., who managed to cool a solid by 0.3K (Epstein 1995), also called optical refrigeration of solids. This is a fast growing flied, with the state of the art being the cooling of solids to cryogenic temperature as low as 100K (Melgaard 2016). In the solid phase of matter a large amount of the thermal energy of the matter is contained in the vibrational modes of the lattice. Thus, a decrease in the vibrational motion of the particles will result in cooling of the material. In analogy to quanta of light, the quanta of vibrational motion are usually referred to as phonons. The two main interactions that are important for laser cooling are: Stokes fluorescence/scattering, which is a process in which light interacts with matter whereby a photon is absorbed and remitted with lower energy, the process is sometimes also luminescence down conversion. The lost energy is converted into thermal energy within the solid. This results, of course, in heating of the interacting material; Anti-Stokes fluorescence/scattering, which is the opposite of Stokes fluorescence (also termed luminescence up conversion). In this process, light interacts with matter so that each photon is scattered with more energy than the energy it started with. The energy is provided by the phonons in the material, leading to cooling of the material after equilibration. The physical principles of laser cooling in solids is aimed at achieving maximum anti-stokes scattering and minimum stokes scattering. Since the type of scattering is highly dependent on the wavelength of the light, lasers, that emit light with a narrow range of wavelengths, have been traditionally used for such studies. Laser cooling using anti-Stokes fluorescence has been investigated and established for some time. Such cooling is achieved due to emission of electromagnetic radiation (photons) with mean energy that is higher than the mean energy of the absorbed radiation. Effectively, heat is converted into light that is emitted from the material.

Radiative emission with higher energy than the absorbed radiation can be modeled with semiconductors having energy band gap between ground and excited levels and a splitting of energy level between two excited levels, where the band gap is an order of magnitude greater than the energy gap between the excited levels. Thermal equilibrium between the two excited level results in population of the higher excited level. Assuming no non-radiative decay of the excited electrons in the higher excited level, then photon emission takes place with frequency higher (shorter wavelength) than the frequency of the photons absorbed, resulting in net cooling.

Laser cooling of solids at the present time can be largely divided into two areas: laser cooling with ion doped glasses or crystals, and laser cooling in semiconductors (bulk or confined, like quantum-well structures), an example of a usage is in radiation-balanced lasers, where the pump wavelength is adjusted so that the anti-Stokes fluorescence cooling compensates for the laser heating. Anti-Stokes solid state coolers, also termed optical coolers, based on the first two options above are effective in reaching temperatures as low as 80 K for rare earth (RE) doped glass and 55 K for direct band gap semiconductors. The main advantage of RE-ions is the optically active 4f electrons shielded by the filled 5s and Sp outer shells, which limit interaction with the lattice surrounding the RE-ion and suppress non-radiative decay. Hosts with low phonon energy, for example, fluoride glasses and crystals, can diminish non-radiative decay and increase quantum efficiency. Laser-induced cooling has been observed in a wide variety of glasses and crystals doped with ytterbium ($Yb^{3+}$) such as ZBLANP, ZBLAN, CNBZn and BIG, YAG and $Y_2SiO_5$, $BaY_2F_8$, $KPb_2Cl_5$, $KGd_2$ and $KY_2$, YLF. Laser-induced cooling has been also observed in thulium ($Tm^{3+}$) doped ZBLANP and $BaY_2F_8$, and in erbium ($Er^{3+}$) doped CNBZn and $KPb_2Cl_5$.

In the Summary below, we present the fabrication and experimental measurements of solid composite materials of ZBLAN 1% Yb3+ and CdS Nano-Belts. These materials have been specifically investigated and found to be rather optional good candidates of materials which can be utilized as active anti-stocks cooling layers in various embodiments of this invention. Such layers can be induced to operate by either a laser or solar radiation at certain wavelength ranges.

ZBLAN 1% Yb3+—This material is a transparent glass. The relevant wavelengths for cooling in this material at ambient temperature (300K) are 1000-1030 nm (Patterson 2010). Below or above these wavelengths, stokes scattering will occur resulting in heating of the material.

CdS Nano-Belts—This material is composed of yellowish belts that appear as an almost uniform yellow piece on a silvery silicon basis. The cooling has been shown to take place in Nano-belts of width 65-120 nm. Any other morphology (Nano-wires/chunks) or belts thicker or thinner than the given range appear to produce mainly stokes scattering (Li 2013). Cooling of this material at 290K is achieved at wavelengths of 507-550 nm, where below the lower threshold (507 nm) Stokes scattering will occur that will result in heating of the material. No data exist for wavelength longer than 550 nm (Zhang 2013).

Production of CdS Nano-belts: Briefly, production of the CdS nano-belts proceeds as follows. The ingredients are Si substrate that is covered with a thin layer of Au (gold), which is used as a catalyst for the process of the creation, and CdS powder. The CdS powder is heated to a temperature of 840° C. degrees and the substrate and the gold film on it should reach a temperature of 680-630° C. The Au film, upon heating, turns to small chunks. A steady flow of Argon (at a rate of 120 sccm), which is a relatively heavy noble gas that does not interact with any of the materials, transports the CdS vapor towards the substrate. Some of the CdS attaches to the gold chunks and belts, which start forming beneath it. After about two hours, if the process was done cleanly enough and all the parameters are fixed correctly, a small layer of CdS belts is formed (Gao 2004).

Experimental Measurement Tools:

Temperature Measurement—IR Camera

All objects emit radiation whose spectrum is dependent on the object's temperature. This radiation is termed black body radiation because in the theory black bodies absorb all the radiation that falls on them and therefore are "black". For temperatures around room temperature the emitted radiation is concentrated mostly at the mid and far-IR part of the spectrum, with wavelengths of around 10 micrometers. IR cameras contain detectors that measure the intensity of photons with these wavelengths. These cameras allow to measure the temperature of a body from a distance, assuming the media through which the photons propagate is transparent to these photons. By measuring the intensity of the IR light, the temperature is easily calculated. In particular, even without calibration, temperature differences and evolution trends can be easily identified.

Temperature Measurements methods—Diode—This method directly measures the temperature of a small diode, which is thermally coupled to the sample one wishes to measure. The voltage drop across the diode increases as its temperature rises by a known amount.

Newton Cooling Model:

Newton cooling is a theory that describes the heat exchange of a body with the environment. The theory assumes that the rate of cooling depends on the temperature difference, giving an exponential solution. Using this solution with adding a constant heat/cooling source gives the equation.

$$d(\Delta T)/dt=-P_{cooling}*1/C+b*(\Delta T)$$

$$C=1/b*L*k=[\mathrm{W*s/K}]$$

Volume/Area=$L$=effective length $k$=constant of the material=1 W/K*m for glass $$\Delta T=T_0-P_{cooling}/L*k+P_{cooling}/L*k*\exp(-bt)$$

Sunlight Simulators

Sunlight simulators are devices that emit light with a spectrum closely matching the solar spectrum impinging on the Earth (after accounting for atmospheric effects). The following graph shown in FIG. 7, produced by the ASTM (American Society for Testing and Materials), shows the intensity of light that reaches the earth as a function of wavelength, with and without atmospheric absorption of light, also referred to as the sun's light spectrum. In addition, it shows the theoretical spectrum as expected by a black body with a temperature of 5778K, like the temperature of the sun's surface.

The following details some basic models for anti-Stokes cooling in RE-doped glass (the 4-level model) and semiconductors.

The 4-Level Model for Optical Refrigeration

Consider basic concepts of laser cooling of solids using $Yb^{3+}$:ZBLANP sample as an example. Energy levels in $cm^{-1}$ and major transitions of $Yb^{3+}$ in ZBLANP are illustrated in FIG. 1(*a*). We then approximate the systems of levels illustrated in FIG. 1 (a) by the 4-level system illustrated in FIG. 1(*b*). In this 4-level system the ground state manifold (2F7/2) is presented by two energy levels with an energy separation δEg=E1−E0, corresponding to the bottom (E0) and to the top (E1) of this manifold. The excited manifold (2F5/2) is presented by two energy levels with an energy separation δEex=E3−E2, corresponding to the bottom (E2).

FIG. 1(*a*) illustrates the energy levels and major transitions of $Yb^{3+}$ in ZBLAN. FIG. 1(*b*) illustrates the 4-level energy model for optical refrigeration consisting of two pairs of levels in the ground (0 and 1) and excited (2 and 3) manifolds.

Optical Cooling in Semiconductors

The recent advances in the development and fabrication of semiconductors have stimulated an interest in semiconductors as candidates for optical cooling. The essential difference between semiconductors and rare-earth doped materials is in their cooling cycles. In the case of RE-doped glasses, the cooling transition occurs in localized donor ions within the host. In the case of semiconductors, the cooling cycle involves transition between extended valence and conduction bands of a direct band gap semiconductor. Laser photons with energy hvp create a cold distribution of electron-hole carriers. The carriers then heat by absorbing phonons followed by an up-converted luminescence at hvf. FIG. 2 schematically illustrates the cooling cycle in a semiconductor with hvp absorbed energy followed by emission of an up-converted luminescence photon at hvf.

Indistinguishable charge carries in Fermi-Dirac distributions allow semiconductors to be cooled to lower temperatures than RE-doped materials. Indeed, the highest energy levels of the ground state manifold in the RE-doped systems become less populated as soon as the temperature is lowered, due to the Boltzmann distribution. The cooling cycle in RE-doped hosts ceases, when the Boltzmann constant times the lattice temperature becomes comparable to the width of the ground state. No such limitation exists in un-doped semiconductors. Following theoretical estimations, temperatures as low as 10 K may be achieved in laser cooled semiconductors. It has been shown that the lattice and the carriers can have different temperatures varying in space and time.

Although semiconductors are very promising materials for laser cooling of solids and their external quantum efficiency increases with decreasing temperature, since the loss terms A and C decrease and the radiative rate (B coefficient) increases inversely with the temperature there are some problems which must be overcome in order to achieve net cooling of a semiconductors experimentally, where the loss terms A, B and C mentioned above, define the nonradiative, radiative and Auger rates of electron-hole recombination (see Nemova G., Laser Cooling of Solids, p. 12, equation (15), reproduced from Sheik-Bahae, M. & Epstein, R. I. (2004), Can laser light cool semiconductors?, *Phys. Rev. Lett.*, Vol. 92, pp. 247403: 1-4, for predicting laser cooling of bulk GaAs).

(1) The surface recombination rate has to be reduced. Well developed epitaxial growth technique such as metal organic chemical vapor deposition (MOCVD), which can provide very low surface recombination rate ($A<10^4$ $sec^{-1}$) can be considered as a promising solution of the problem. In this case, an active layer of GaAs is sandwiched between two thin layers of AlGaAs or InGaP. These lattice-matched cladding layers provide surface passivation and carrier confinement at the same time and (2) the parasitic background absorption has to be reduced. The background absorption can be reduced during material preparation with well developed epitaxial methods. The extraction efficiency can be enhanced if total internal reflection, which causes trapping and re-absorption of spontaneous emission, can be prevented. At the present time the purity of the samples is the main obstacle on the path to achieving net laser cooling in semiconductors.

Candidate materials which have an energy-level diagram similar to the one drawn in FIGS. 1(*a-b*) and 2 include semiconductors (excited across their band gaps), rare-earth or transition-metal doped crystals and glasses, and polyatomic molecules in any phase (excited between vibration levels).

The major shortcomings of current anti-Stokes based cooling technologies are the requirement for excitation by laser and tuning to very specific radiation wavelength. This may prove efficient for particular applications where very low temperature is required and monochromatic radiation is used. However, to this point, anti-Stokes based cooling method has not been applied at conditions of temperature and non-monochromatic radiation. This drawback further limits the application of anti-Stokes effect to rather small scale applications.

Based on laser cooling of solids using anti-Stokes fluorescence and its disadvantages as described above, it is desirable to replace the energy source, namely the laser pump, with a more naturally available wider spectrum source of radiation, e.g. taken from the solar spectrum. Further, it is desirable that the spectral band be tailored to match the material exhibiting anti-Stokes florescence.

REFERENCES

[Epstein 1995] Epstein, R. I., Buchwald, M., Edwards, B., Gosnell, T. & Mungan, C. Observation of laser induced fluorescent cooling of a solid. Nature 377, 500-503 (1995).

[Melgaard 2016] Melgaard, S. D., Albrecht, A. R, Hehlen, M. P., Sheik-Bahae, M. Solid-state optical regfrigiration to sub-100 Kelvin regine, Nature scientific reports (2016).

[Patterson 2010] Patterson, W. M., Seletskiy, D. V., Sheik-Bahae, M, Epstein, R. I., Hehlen, M. P. Measurement of slid-state optical refrigeration by two-band differential luminescence thermometry, Jour. Opt. Sci. Am. B 27, 611 (2010).

[Li 2013] Dehui Li, Jun Zhang, and Qihua Xiong, Laser cooling of CdS nanobelts: Thickness matters, Optics Express Vol. 21, Issue 16, pp. 19302-19310 (2013).

[Zhang 2013] Jun Zhang, Dehui Li, Renjie Chen & Qihua Xiong, Laser cooling of a semiconductor by 40 Kelvin, Nature 493, 504-508 (24 Jan. 2013)

[Gao 2004] Tao Gao and Taihong Wang, Catalyst-Assisted Vapor-Liquid-Solid Growth of Single-Crystal CdS Nanobelts and Their Luminescence Properties, J. Phys. Chem. B, 2004, 108 (52), pp 20045-20049 (Nov. 24, 2004).

[Fontenot 2016] Fontenot, R. S., Veerrendra, K. M., Barkyyoumb, J. H., Mungan, C. E., Tran, T. N., Measuring the anti-Stokes luminescence of CdSe/ZnS quantum dots for laser cooling applications, Proc. Of SPIE 9821, 982103 (2016).

It is, therefore, an object of the present invention to provide a technology and method for cooling larger scale objects and surfaces using anti-Stokes effect.

It is yet another object of the present invention to provide technology and method for anti-Stokes based cooling of objects and surfaces by using a wider spectrum of electromagnetic radiation.

Particularly, it is also an object of the present invention to provide technology and method for anti-Stokes based cooling of objects and surfaces by using the solar radiation.

SUMMARY

In one aspect, the present invention pertains to cooling technology using anti-Stokes fluorescence in materials that respond to wide band solar radiation.

In one particular embodiment, the present invention uses semiconductor materials for wide band-gap anti-Stokes cooling under wide spectrum solar radiation.

In still another particular embodiment, RE-doped synthetic materials are used for obtaining anti-Stokes fluorescence using wide range solar radiation.

The general characteristics of materials used in the present invention for cooling based anti-Stokes fluorescence are detailed in the following points:

1. Each material which exhibits anti-Stokes florescence has a spectral band in which it up-converts the absorbed photons and cools.

In one particular embodiment, the spectral bandwidth is between ~50 nm and ~100 nm that allows the use of a non-monochromatic radiation.

2. Using the anti-Stokes effect with a range of frequencies (inside the spectral band) rather than a single one does not alter the possibility of performing cooling due to the existence of the anti-Stokes reaction across the entire spectral band.

3. The active cooling does not depend on the coherent nature of the radiation, which enables the usage of incoherent solar radiation as the active cooling input power source.

4. The cooling technology of the invention is suitable for small and large scales and practically for any object with surface on which the layer substance can be applied or overlaid, e.g., roof, wall, car, ship, tent, clothing, etc.

In contrast, laser cooling technology experiments were performed on small objects of up to few mm in length because:

a. The goal of these experiments was to reach the minimal temperature possible—this is the reason for using small objects which cool faster.

b. Since the laser pump consumes energy, using small objects allows the use of the existing laser pumps without the need for customization.

c. However, all these reasons do not contradict the use of the technology on a large scale.

In one aspect, to achieve large scale cooling with anti-Stokes fluorescence, the present invention provides a cooling technology that uses incoherent electromagnetic/solar radiation, which is absorbed by a layered substance. The layered substance can be paint or fabric. The substance generates cooling effect in an object on which it is overlaid by emitting anti-Stokes fluorescence. As explained above, anti-Stokes fluorescence is obtained with laser pumping, exciting ground level electrons to excited state, where the excited electrons further absorb phonons and fluoresce back to ground level with energy greater than the energy of excitation. Effective cooling is obtained when heat is converted into light, which leaves the material. However, in the present invention, the laser pump is replaced with a wide range spectral band taken, for example, from the solar spectrum, which is tailored to match the substance that exhibits anti-Stokes florescence.

Further, in one particular embodiment, the present invention provides a double- or multi-layer structure that filters the radiation spectrum and transmits only a selected band to the layer that displays anti-Stokes fluorescence. Thus, the top layer shields the bottom layer from unnecessarily absorbed radiation and actually renders the cooling effect more efficient by increasing the ratio of radiation output-input.

Such double- or multi-layer structure filters a radiation spectrum by reflecting most of it back and away by the outer layer and transmitting a selected band of it to a second layer. The second layer in the invention absorbs the selected part of the spectrum, shifts it to a shorter wavelength range using anti-Stokes effect and emits it in a radiative manner As a result, a cooling effect is obtained. The filtering step that precedes the generation of the anti-Stokes effect actually replaces the requirement for tuning a laser beam to an accurate monochromatic wavelength. Instead, the top layer substitutes with such "tuning". Further, there is no real requirement for fine tuning of the incoming radiation as in laser pumping in the present invention. Rather, the materials that comprise the bottom layer in the present invention respond to a selected band of wavelengths and produce anti-Stokes shift and a cooling effect with incoherent incoming radiation. Further, the cooling effect is intensified and improved when filtering the entire spectrum on the one hand and using materials that respond to a band of wavelengths according to the invention than an accurate wavelength on the other hand.

In addition to the above, one particular application of the double- or multi-layer structure of the invention is as paint, which is applicable to different materials and surfaces, i.e., concrete, fabrics, glass windows and so on, which is another novel and inventive aspect of the invention. Namely, a technology for fabricating a double- or multi-layer paint with physical and/or chemical compatibility with surfaces of different materials proves to be substantially efficient for different applications that would otherwise not be able to enjoy any anti-Stokes fluorescence based cooling. Accordingly, in another particular embodiment, corresponding products of such paint and particular objects over which it is laid or imbedded in are contemplated within the scope of the present invention.

The selection of materials that make such double- or multi-layer paint including those that participate in the reflectance and anti-Stokes shift and their medium are important for reducing the invention to practice. Preferably, such materials should not only prove efficiency of the cooling effect obtained by anti-Stokes shifting but also long term compatibility with the materials with which they come in contact. Also preferably, a paint that is formed of such layers should also show long term activity when overlaid on surfaces or imbedded in objects made of different materials to gain further advantage.

In still another particular embodiment, the double- or multi-layer paint for cooling an object over which it is laid or imbedded in using anti-Stokes shift according of the present invention comprises the following characteristics:

1. Anti-Stokes shift obtained from absorption and fluorescence of a band of wavelengths and a resulting improved cooling effect achieved with such fluorescence.

2. Use of a double- or multi-layer structure for filtering by reflection of a spectrum of electromagnetic radiation and responding to a selected band of the spectrum that is absorbed in the fluorescing layer.

3. Application of such double- or multi-layer structure as paint that can be overlaid on different surfaces or imbedded in different materials, and which is compatible with such surfaces and materials and has long term life and activity.

In still another particular embodiment, the basic layer structure of the substance of the present invention comprises two types of layers:

1) Top layer—which is the spectral filter layer.

2) Bottom layer—which is the active cooling layer.

This results in the possibility of using specific spectral bands extracted from the solar radiation for anti-stokes florescence cooling.

In view of the above, in one particular embodiment, the spectral filter layer is the top layer which is exposed to solar radiation and serves as a filter layer that reflects most of the solar radiation back to the atmosphere and transmits a specific/selected range of wavelengths tailored to the active cooling layer. In still another particular embodiment, the active cooling layer is the bottom layer, which absorbs the selected wavelengths transmitted through the filter layer and loses thermal energy via photon up-conversion, i.e., active cooling.

It should be noted that anti-Stokes fluorescence cooling as in the present invention is done without electricity input, moving parts, gases, liquids and any additional substance other than the layer substance as defined above.

Particular non-limiting examples of compounds that can be used for anti-Stokes fluorescence for the bottom layer of the layer substance of the present invention are listed in Table I below:

TABLE I

Candidate Materials for Anti-Stokes Fluorescence for the Bottom Layer of the Layer Substance of the Present Invention

| Efficiency | Wavelength | Material |
|---|---|---|
| 4.8% efficiency from power on to cooling | 505 nm-560 nm | Cadmium Sulfide |
| 94% efficiency. Not tested yet | ~600 nm-~660 nm (1.94 eV average) | Gallium Arsenide (GaAs) quantum wells |
| 9 W laser, cooling power of 140 mW up to 165° K. | 1023 nm | Ytterbium-doped yttrium lithium fluoride (Yb:YLF) crystal |
| 2% efficiency Positive efficiency of 2% | 1010 nm-1050 nm | Ytterbium-doped tungstate crystal (Yb:KGW) |
| 2% | 1015 nm | fluorozirconate glass (ZBLANP) doped with 1 wt % Yb3+ |
| unknown | 300 nm | 9Be+ |
| 3% | 894 nm + 795 nm + 761 nm | Cesium |
| ~2.5% | 610 nm-660 nm | CdSe/ZnS |

Table I above details the spectral band required for each of the materials presented therein to obtain anti-Stokes fluorescence and the efficiency of conversion of absorbed to emitted radiation.

In still another particular embodiment, the top filtering layer of the present invention may be selected from synthetic or natural materials that filter incoming electromagnetic radiation to the spectral band that is suitable for exciting ground level electrons to excited level and effecting anti-Stokes fluorescence in the active component in the bottom layer. In one particular application, synthetic polymers are used. Such synthetic polymers may either thermoplastic or thermoset polymers. Particular examples of such synthetic polymers are listed as follows: Acrylic Polymers, Olefin polymers, particularly PE (Polyethylene) and PP (Polypropylene), HDPE (High Density PE), MDPE (Medium-density polyethylene), LLDPE (Linear Low Density PE),and LDPE (Low Density PE), VLDPE (Very-low-density polyethylene), UHMWPE (Ultra-high-molecular-weight polyethylene), ULMWPE or PE-WAX (Ultra-low-molecular-weight polyethylene), HMWPE (High-molecular-weight polyethylene), HDXLPE, (High-density cross-linked polyethylene), PEX or XLPE (Cross-linked polyethylene), CPE (Chlorinated polyethylene), PVC (Poly Vinyl Chloride), m-LLDPE (Metallocene linear low density PE), PC (Polycarbonate), PVA (Polyvinylalcohol), EVA (Ethylene vinyl acetate) polymer, Polyester polymers (PSR), particularly PLA (Polylactic acid), PCL (Polycaprolactone), PEA (Polyethylene adipate), PBS (Polybutylene adipate), PET (Polyethyleneterphthalate), PBT (Polybutyleneterphthalate), PEN (Polyethylene naphtalane), Styrene polymers, particularly PS (Polystyrene), Styrene-Butadiene polymers, PUR (Polyurethane), foamed PUR, Fluorinated polymers, particularly Teflon, Nylon 6,6, and Nylon 6, polymeric resins, acrylic resin and combination thereof.

The top layer is not limited to synthetic materials or even solid materials as long as they perform the filtering required and allow the transmission of the suitable spectral band to the bottom layer. Therefore, in one particular embodiment, the top layer may be selected from the following list of materials: Water, Aluminum Hydroxide, Calcium Carbonate, Titanium Dioxide, Zinc Oxide, Silica, Quartz, Chlorothalonil, Polysiloxanes, Nepheline Syenite, Titanium Dioxide, Silane, Methyl Ttri(ethylmethyl ketoxime), Octamethylcyclotetrasiloxane, Amorphous Silica, organic pigments, inorganic pigments, ceramic pigments, iron oxide, oxides, ceramic microspheres, propylene glycol, amorphous silica, naphta (hydrodesulfurized heavy petroleum), xylene, calcium carbonate, hydrocarbons, cyclo-alkanes and ethanol.

Regarding the bottom layer, the synthetic polymers listed above may be used as a matrix that hosts the active component of the bottom layer. Accordingly, RE (Rare Earth) ions or crystals or crystallites of semiconductors may be embedded in such synthetic matrix made of any one of the polymer listed above and combination thereof.

When applying the bottom and top layers in paint form that may be spread over the surface or object to be optically cooled, synthetic polymers may be used. For example, for the top layer, any one of the synthetic polymers listed above may be provided either in melted or dissolved phase when applied to the surface or object and let to cool or dry depending on the method of application. Similar methods of application may also be used for the bottom layer, where the synthetic polymer is also used as host matrix for the active component embedded in it. Particularly, the active component is evenly distributed within the matrix to provide sufficient cover to the surface or object and collect the filtered spectral band that is suitable for electron excitation.

In still another particular embodiment, the bottom and top layers may be incorporated into the material that makes the surface or fabric. For example, the material may be textile, in which the top layer is embedded in the outer surface of the textile fibers and the bottom layer in the fibers core. In still another particular embodiment, the materials that make the top and bottom layers may be introduced into the material that makes the fiber in the process of making the fibers. This way, a filtering layer and a fluorescing layer are already built in the fibers that make the textile. Further, the fluorescing layer may be introduced into fiber in one stage of preparing the fiber, namely when constructing the fiber core, and the filtering layer in a next stage of constructing the fiber shell. Different methods of preparation of fibers may be used, where the fluorescing and filtering materials of the present invention may be introduced at any stage of the process to obtain a fluorescing fiber core and a filtering fiber coating.

Synthetic and natural textiles are contemplated within the scope of the present invention. Particular examples of such textiles are listed as follows: wool, cashmere, silk, satin, velvet, taffetas, cotton, flax, jute, hemp, modal, bamboo fiber, seaweed, alginate, lyocell (manmade fabric derived from wood pulp), Cordura (nylon, nylon mixed with cotton or other natural fibers), basalt fibers (used for vinyl tiles, sheeting, curtains and fire blankets), metal fibers, synthetic fibers such as aramid, acrylic, nylon, spandex (i.e. lycra), olefin fibers, inego (polylactide fibers), lurex (metallic fibers), milk protein-based fibers, carbon fibers and mixtures of synthetic and natural fibers and any combination thereof.

In one particular embodiment, the synthetic material for the synthetic layer may be recycled, and comprise a mixture of different types of synthetic polymers. Otherwise, it may contain single type of synthetic polymer, a mixture of synthetic polymers with known relative amounts or block co-polymers that comprise different polymeric compounds chemically bonded to each other and forming a single polymer chain. FIG. 5 schematically illustrates the layered substance and the cooling effect generated.

In still another particular embodiment of the present invention, the deposition of the at least one bottom layer which is configured to respond in anti-Stokes fluorescence upon absorption of electromagnetic radiation; and the at least one top layer which is overlaid on the bottom layer and configured to filter the electromagnetic radiation and transmit selected spectral band of the electromagnetic radiation to the bottom layer are deposited and processed on a thin or Si or SOI substrate and wafers or on wafers based on Si or Ge substrate or Si or Ge Epitaxial layers, or on any wafer based on III-V materials such as GaAs wafers or based on III-V epitaxial layers, where the Si and SOI Wafers can be fabricated with low or high thermal and electrical resistance.

In still another particular embodiment of the present invention, the substrate layers can be removed in a chemical and/or mechanical further process, such as a grinding process done on the wafer or die back side after completion of processing the related active cooling device composed of two or multi layer devices.

Further, the process for preparing the apparatus can be done on wafer, die level, on a sample that contains an array of devices or on single device level.

In still another particular embodiment of the present invention, the at least one top layer which is overlaid on the bottom layer and configured to filter the electromagnetic radiation and transmits selected spectral band of the electromagnetic radiation to the bottom layer are deposited and processed can be mounted, glued, coated, evaporated on, deposited or mechanically or chemically attached above the bottom active cooling layer. Such deposition method comprises Chemical Vapor Deposition (CVD) including in Low (LPCVD) and High (LPCVD) Pressure, electrodeposition, Physical Vapor Deposition (PVD) and casting deposition method, thermal oxidation. epitaxial growth, and thermal oxidation deposition method.

In still another particular embodiment of the present invention, the apparatus said that comprises at least one bottom layer, which is configured to respond in anti-Stokes fluorescence upon absorption of electromagnetic radiation, and the at least one top layer which is overlaid on the bottom layer and configured to filter the electromagnetic radiation and transmit selected spectral band of the electromagnetic radiation to said bottom layers further comprises a buffer layer or a residue layer of the bonding martial, air gaps or other residue layers or materials between the top and bottom layers.

In still another particular embodiment of the present invention, the apparatus further comprises light transparent passivation layer that covers the apparatus or the at least one top layer which is overlaid on the bottom layer and configured to filter the electromagnetic radiation and transmit selected spectral band of the electromagnetic radiation to the bottom layer. In still another particular embodiment, the passivation layer is between the top filtering layer and the at least one bottom layer which is configured to respond in anti-Stokes fluorescence upon absorption of electromagnetic radiation. The passivation layer is deposited on top or between said top and bottom device layer protects the layer properties from any physical chemical or electrical damage and in addition minimizes as possible its degradation over time and thermally and electrically isolates the cooling device active layers as possible from undesired environmental impact that can damage the top and bottom layer properties and degrade the apparatus physical, mechanical and electrical properties. In a further embodiment, the at least one layer can be between the top and bottom layers or under the bottom layer.

BRIEF DESCRIPTION OF THE DRAWINGS

FIG. 1(*b*) shows an example of the 4-level model for optical refrigeration.

FIG. 8 shows the experimental system of the temperature measurement with IR camera.

FIG. 9 shows the spectrometer experimental system.

DETAILED DESCRIPTION OF THE DRAWINGS

Figure 1A:
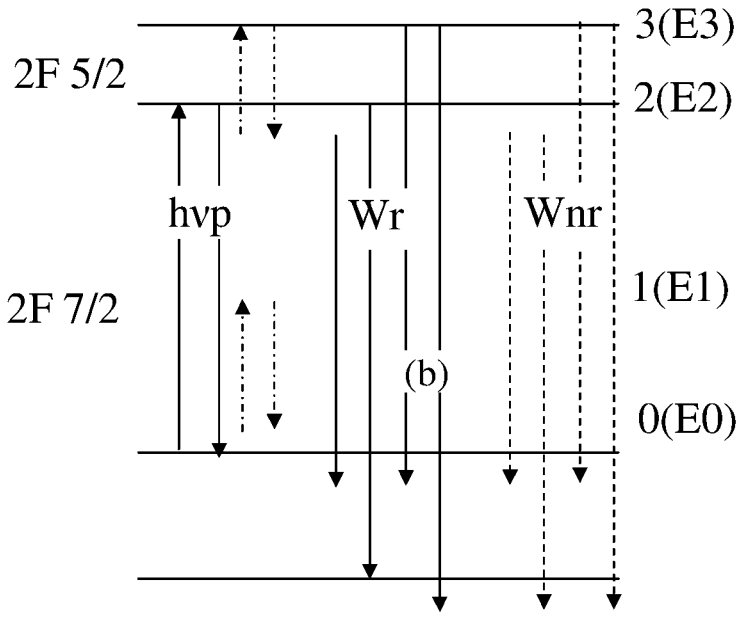
FIG. 1(*a*) shows the 4-level model for optical refrigeration.
Figure 1B:
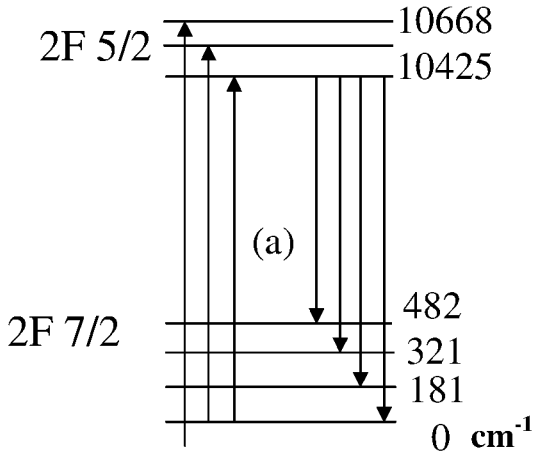

As explained above, FIG. 1(*a*) (reproduced from Nemova G., Laser Cooling of Solids, p. 4, FIGS. 1(*a*)-(*b*)), shows the 4-level model for optical refrigeration for RE-doped glass, for example $Yb^{3+}$:ZBLANP. Although the diagram initially relates to laser cooling, it is equally relevant to wide band radiation. A particular calculation for the 4-level model is shown in FIG. 1(*b*) (units in $cm^{-1}$).

Figure 2:
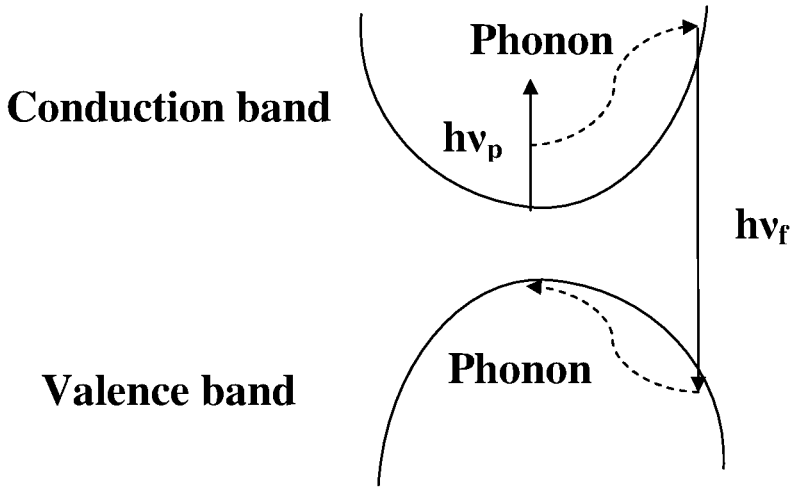
FIG. 2 shows the semiconductor model for optical refrigeration.

Optical cooling in semiconductors is schematically illustrated in FIG. 2 and has been discussed earlier in the present application. The up-conversion of the excited photons resulting from thermal equilibrium between neighbor excited energy levels leads to photon emission with energy higher than that of the photon absorbed. Thus the optical cooling effect in semiconductor materials is achieved by phonons absorption and conversion of thermal energy to electromagnetic energy.

Figure 3:
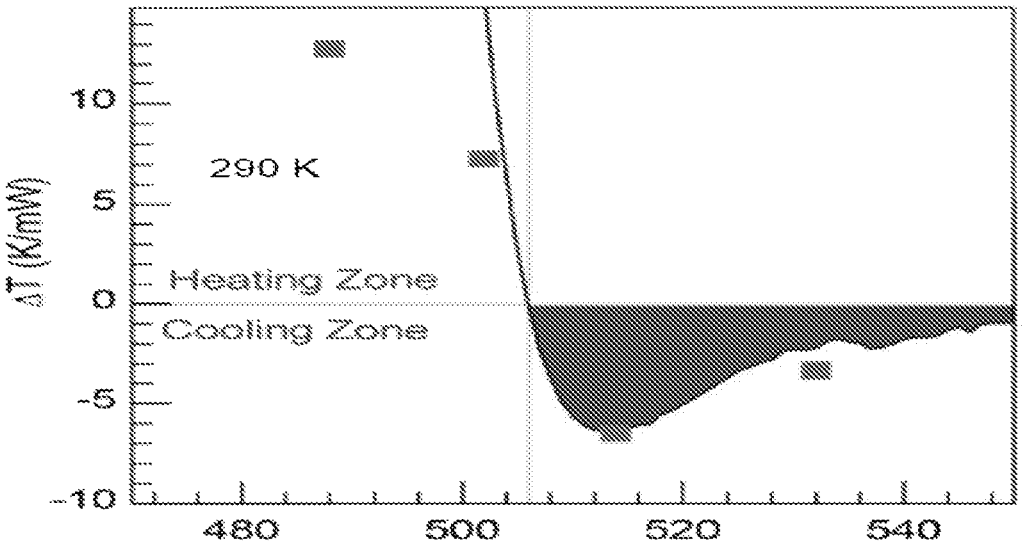
FIG. 3 shows a plot of calculated temperature change with optical cooling.

FIG. 3 (reproduced from, Jun Zhang, Dehui Li, Renjie Chen, Qihua Xiong, Laser Cooling of a Semiconductor by 40 Kelvin: An Optical Refrigerator Based on Cadmium Sulfide Nanoribbons, Proc. of SPIE Vol. 8638) is an example plot of measured maximum ΔT (squares) and theoretically calculated temperature change curve (solid line) normalized to the pump power in K/mW for different pump wavelengths at 290K. The solid region corresponds to the cooling zone for Cadmium Sulfide engineered material. A drop of temperature resulting from absorption of photons with wavelengths between 505 nm and 560 nm can clearly be seen. Applying to wide band radiation as in the present invention, using a ~505 nm-~560 nm spectral band extracted from the solar radiation on Cadmium Sulfide would generate anti-stokes fluorescence resulting in effective cooling.

Figure 4:
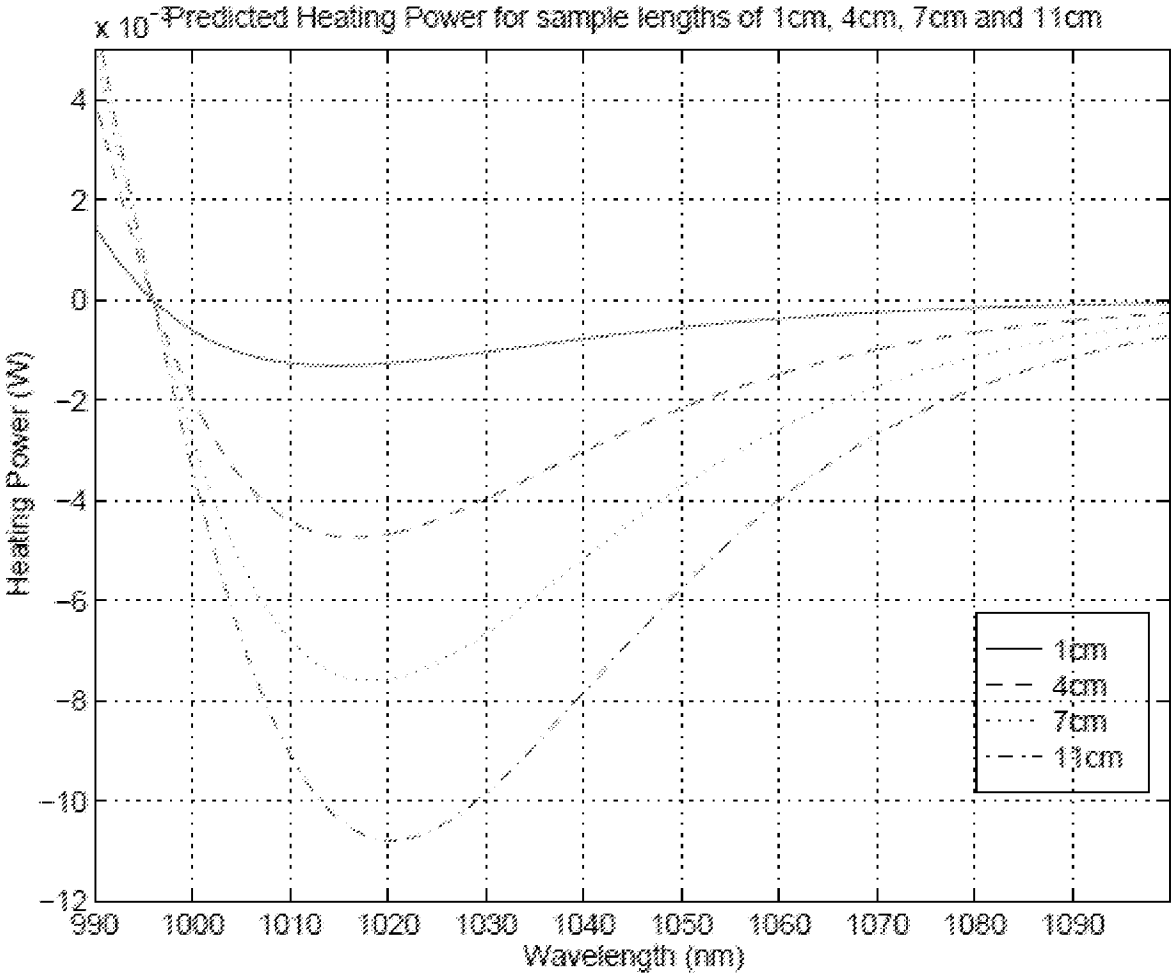
FIG. 4 shows a plot of temperature change curves for ytterbium-doped ZBLAN.

FIG. 4 (reproduced from Anton Rayner, B.Sc. (Hons), Laser Cooling of Solids, Effect of Quantum efficiency and sample length, A thesis submitted to the University of Queensland for the Degree of Doctor of Philosophy, Department of Physics, January 2002) is another example plot of measured maximum AT and theoretically calculated temperature change curve for ytterbium-doped ZBLAN. A drop of temperature resulting from absorption of photons with wavelengths between 995 nm and 1100 nm is clearly observed. These two examples in FIGS. 3 and 4 are also valid for the case of optical cooling with wide band radiation as in the present invention.

Figure 5:
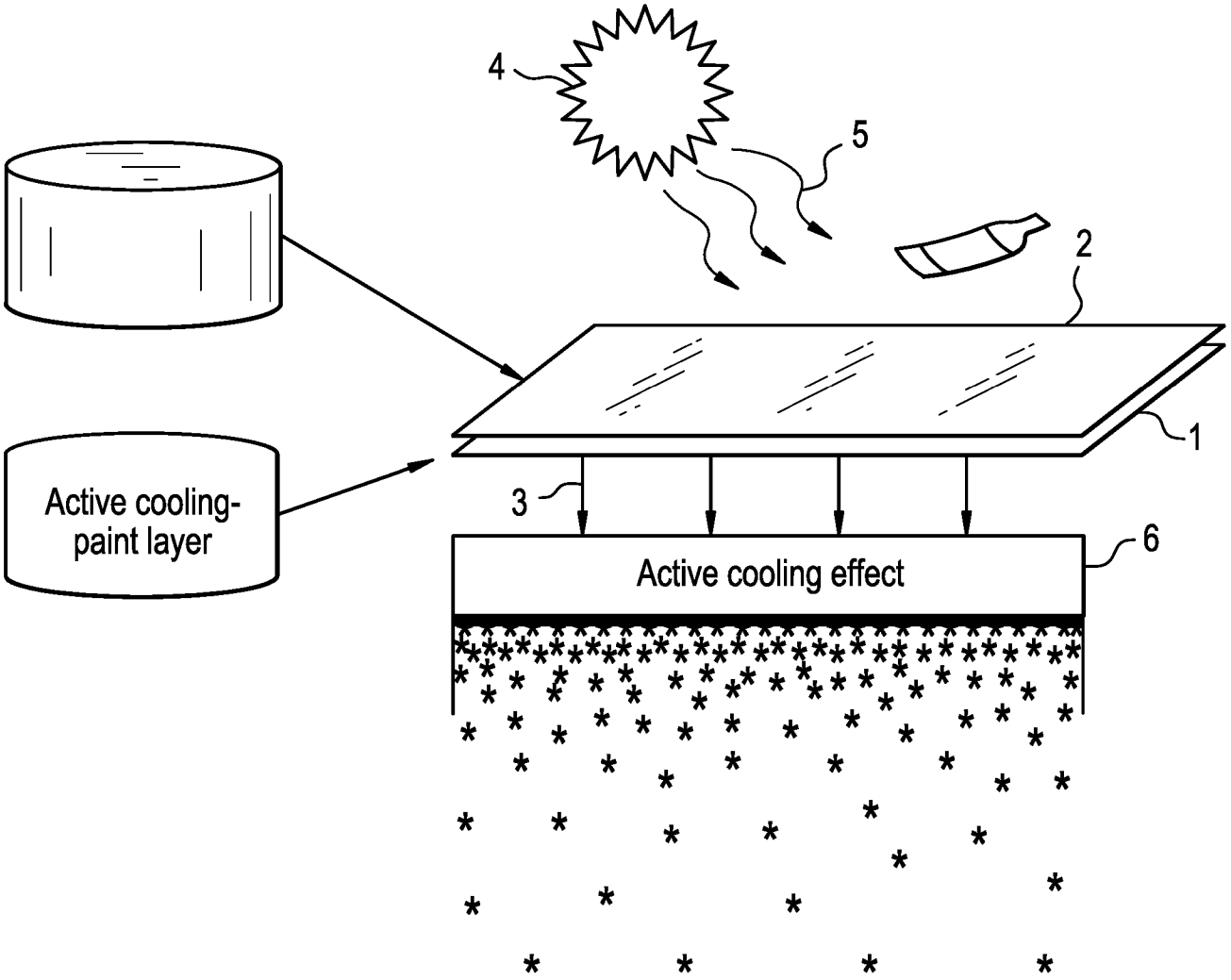
FIG. 5 schematically illustrates cooling effect obtained with a double layer paint of the present invention.

FIG. 5 schematically illustrates a particular configuration of a double layer of the present invention for generating optical cooling effect in an object (6). In this example, the two layers are provided as paint for coating the surface of the object (6) to be cooled. The bottom layer (1) is the active cooling layer that absorbs a selected spectral band of the solar radiation (5) under exposed conditions of the object (6) to the sun (4). The active layer (1) responds in anti-Stokes fluorescence (3), namely electromagnetic radiation with mean energy higher than the energy of the solar radiation that is absorbed. Cooling of the object (6) by the conversion of heat to electromagnetic radiation follows. The top layer or roof coating (2) filters the solar radiation (5) by reflecting part of it back into the atmosphere and allowing the appropriate spectral band to pass to the bottom active layer (1), where this spectral band is suitable for generating anti-Stokes fluorescence in the bottom layer (1) and optical cooling of the object (6).

As described above, the double layer of the invention may be implemented in different configurations and for different uses.

Figure 6:
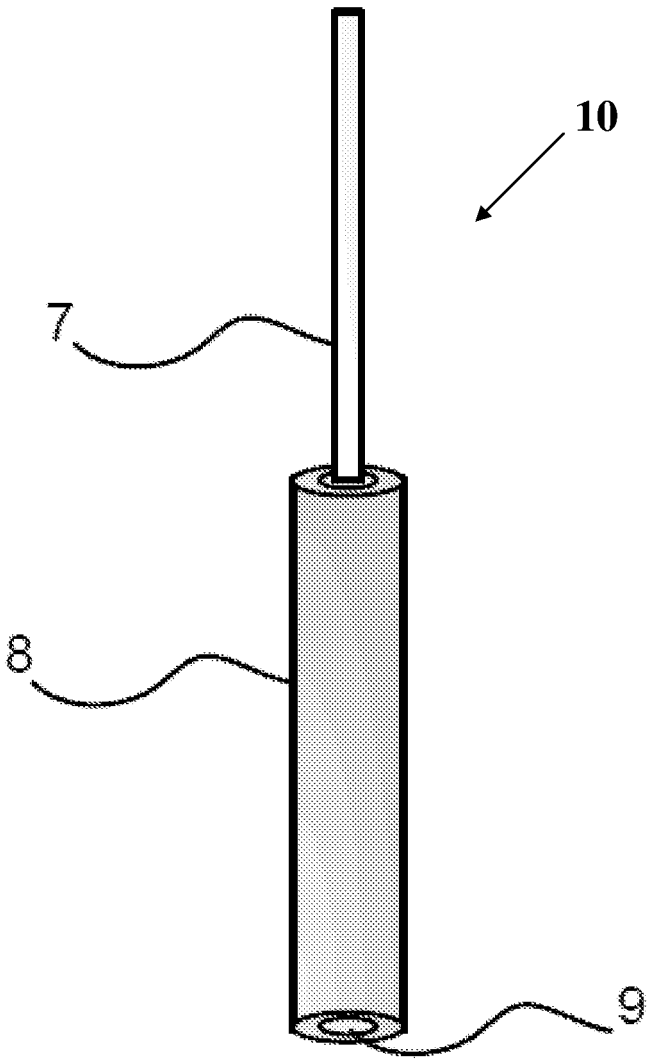
FIG. 6 schematically illustrates cooling effect obtained with a double layered fiber (core & shell) of the present invention.
Figure 7:
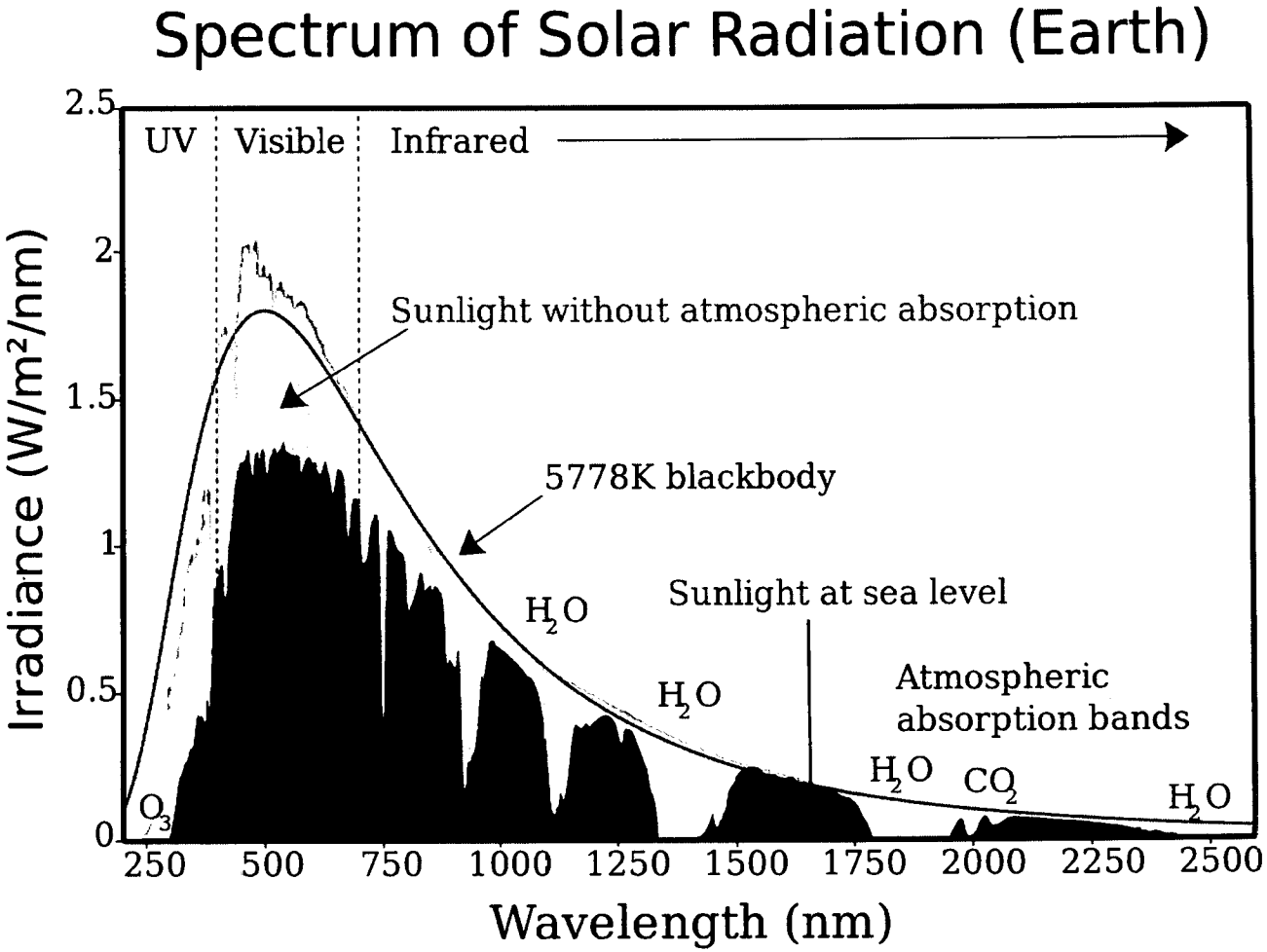
FIG. 7 shows thee spectrum of the sun, which is modeled as a black body with a temperature of 5778K (shown in the solid line) with and without the atmospheric absorption.

FIG. 6 schematically illustrates one particular implementation of the double layer structure of the invention in a double layer fiber (10). The shell (8) of the fiber (10) is the top layer that filters the incoming radiation to the desired wavelength range as depicted in FIG. 5. The core (7) of the fiber (10) is the bottom fluorescing layer that receives and absorbs the radiation in the filtered wavelength range and responds by emitting radiation in anti-Stokes fluorescence. The hollow inner space of the fiber (10) is sufficient to accommodate the core (7) as seen in the bottom (9) opening of the fiber core. FIG. 6 illustrates a structure of a fiber (10) that is suitable for any structure that comprises fibers and is used to cover an object that requires cooling or shield it from a heat source. In one particular example, the structure of the fiber (10) may be used in textiles for any use for cooling objects, bodies and spaces by covering them with the protective cooling textile or shielding them from a heat source. Particular applications of such covers and shields are selected from clothing, drapes, shades, curtains, bags, camping gear, food cooler covers and the like.

The following description verifies experimentally the anti-Stokes active cooling modeling and invention presented in FIGS. 1-6, and demonstrate experimentally anti-Stokes active cooling mechanism which is induced by a solar radiation simulator on ZBLAN 1% Yb3+ sample. The experimental results are presented in FIGS. 8-16. In addition, the description exemplifies sample preparation of CdS active layer by fabrication and processing of chunks on Si substrate, which is considered a first step toward fabrication of active cooling layer of CdS nano-belts structure on Si substrate. In these experiments, the second layer is configured to filter incoming electromagnetic radiation and transmit selected spectral band of it to the bottom layer. The experimental results shown in FIGS. 8-16 display exemplary embodiments of the cooling layer of the present invention as schematically illustrated in FIGS. 1-6. These figures are for illustration and demonstration purposes and are not intended to be exhaustive or to limit the invention to the below description in any form.

Experimental

Temperature Measurements Using an IR Camera

Experimental System

The experimental system (100), shown in FIG. 8, was composed of a vacuum chamber (15) that contained a stand (16) with ceramic screws (for low heat conductance, not shown in the figure) that held a sample of the material or sample under test (10). The chamber had two windows (11) and (12) on its top side. Window (11) in FIG. 8 was made of regular glass (BK7), which is transparent to the near IR and the visible spectrum, so that the light (13) from the solar simulator could pass through to the sample. Various optical elements (14) were placed in between the sunlight simulator and the vacuum chamber, marked as "Optics" in FIG. 8. The main components were filter apparatuses, which were designed to block irrelevant parts of the solar spectrum and a lens that focused the light (13) from the simulator on the sample (10). Window (12) in FIG. 8 was made from ZnSe, which is a transparent material to the radiation of the IR camera. The IR camera (17) was directed at the sample through window (12).

For the IR camera (17) we used Gobi-640-Gige-4782 with a thermal resolution of 0.05° C., an error of about 1° C. and sensitivity to wavelengths between 8-14 micrometers. The lens used in the IR camera (17) is a focusing lens with focal length of about 7 cm. The filters (14) we used allowed very high transmittance (>90%) in the 1000-1300 nm range for the first filter and 505-560 nm for the second filter and almost no transmittance in any other wavelength in the solar spectrum (>1%). The sunlight simulator (13) had a total power of 10 W.

Experimental Procedures

We started by testing the camera on objects that are known to be hotter/colder. Next, we tried to measure our Ytterbium-doped ZBLAN sample (notated as ZBLAN) with and without solar light, and see changes in the temperature. Based on the literature, we used the 1000-1030 nm filter for the ZBLAN. We also experimented with changing conditions including different angles of the camera and the samples, filtered and unfiltered light, with and without vacuum (vacuum of 60+−10 Torr), with and without the cover of the vacuum chamber, with and without a mirror below the ZBLAN sample (for light recirculation), with without an absorbing material in the vacuum chamber, with/without the windows of the vacuum chamber, with different lenses/no lens and with different glasses which are not expected to cool as reference samples.

Results and Discussion

Figure 10:
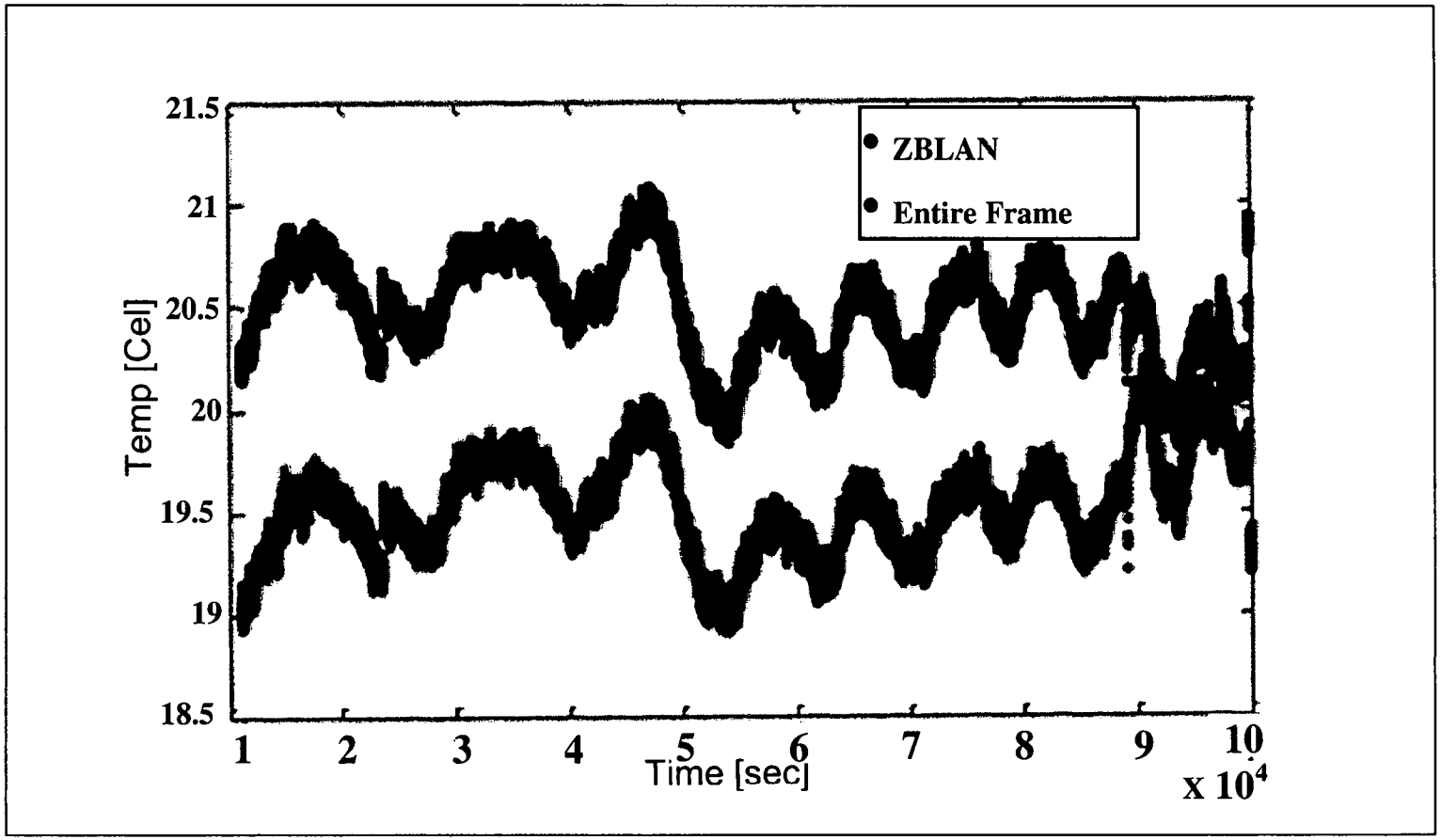
FIG. 10 shows the experimental results with the temperature as a function of the ZBLAN glass and the entire frame.
Figure 11:
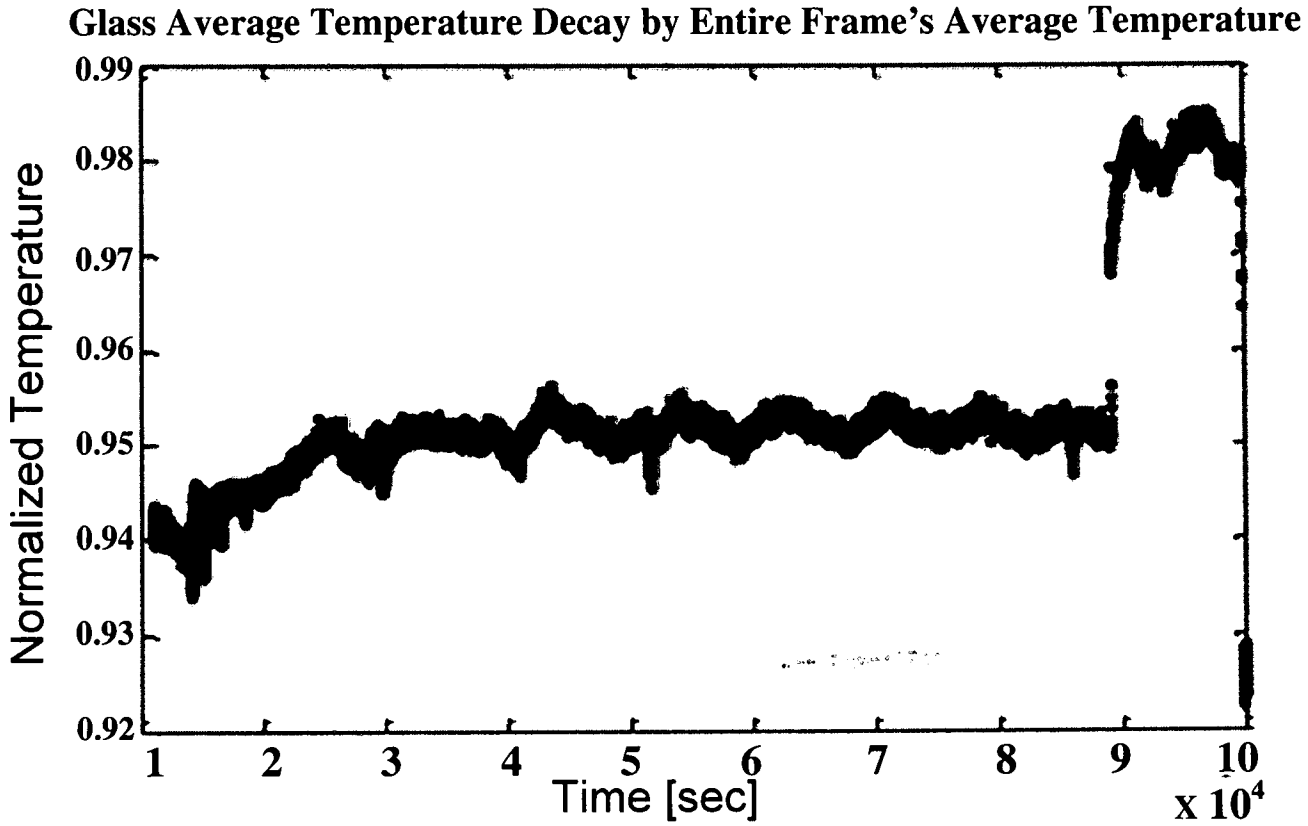
FIG. 11 shows a graph with extracted experimental results from FIG. 10 with the average temperature normalized by the entire frame with filtered sunlight reaching from the 4000 second.

When we used no filter the samples were always heated, as expected, due to Stokes scattering in the materials. The ZBLAN sample and the reference glasses samples showed no change in temperature with the 1000-1030 nm filter. We analyzed the data taken by the camera by taking the average of the glass's temperature and the average of the entire frame's temperature and then removing the effects that are apparent in the entire frame from the function of temperature of the glass. FIG. 10 (lower graph) shows the temperature as a function of time of the ZBLAN glass and the entire frame. We normalized and extracted the change in temperature of the ZBLAN sample, shown in FIG. 11.

Experimenting the sample was first allowed to reach equilibrium with the shutter closed and then the temperature recording started at the 0 second mark with the shutter still closed. The shutter was then opened at the 4000 second mark. We can clearly see in both graphs that opening the shutter did not have an apparent effect on the sample. Equivalent results were obtained for many different conditions. In the next step, we improved and modified the experimental measurement setup (100), shown in FIG. 8, in order to realize an anti-Stokes scattering cooling effect.

Using a Spectrometer to Detect Anti-Stokes Scattering

Experimental System

The modified experimental system (200), shown in FIG. 9, was very similar to (100) that used the IR camera, except for the replacement of its cover part (18) with a thick aluminum foil cover that blocked light however did not hold a vacuum condition in the chamber (15). The modified system also included the replacement of the IR camera (17), shown in FIG. 8 with a spectrometer (19) (Oceanview USB 2000+) with a resolution of less than 1 nm, as can be seen in FIG. 9.

Experimental Procedures

The first measurement was of the light from the solar simulator and then measurements of the ZBLAN and the reference glasses that were taken with simulated sunlight. Then, measurements with filtered light were taken for ZBLAN and reference glasses.

Results and Discussion

Figure 12:
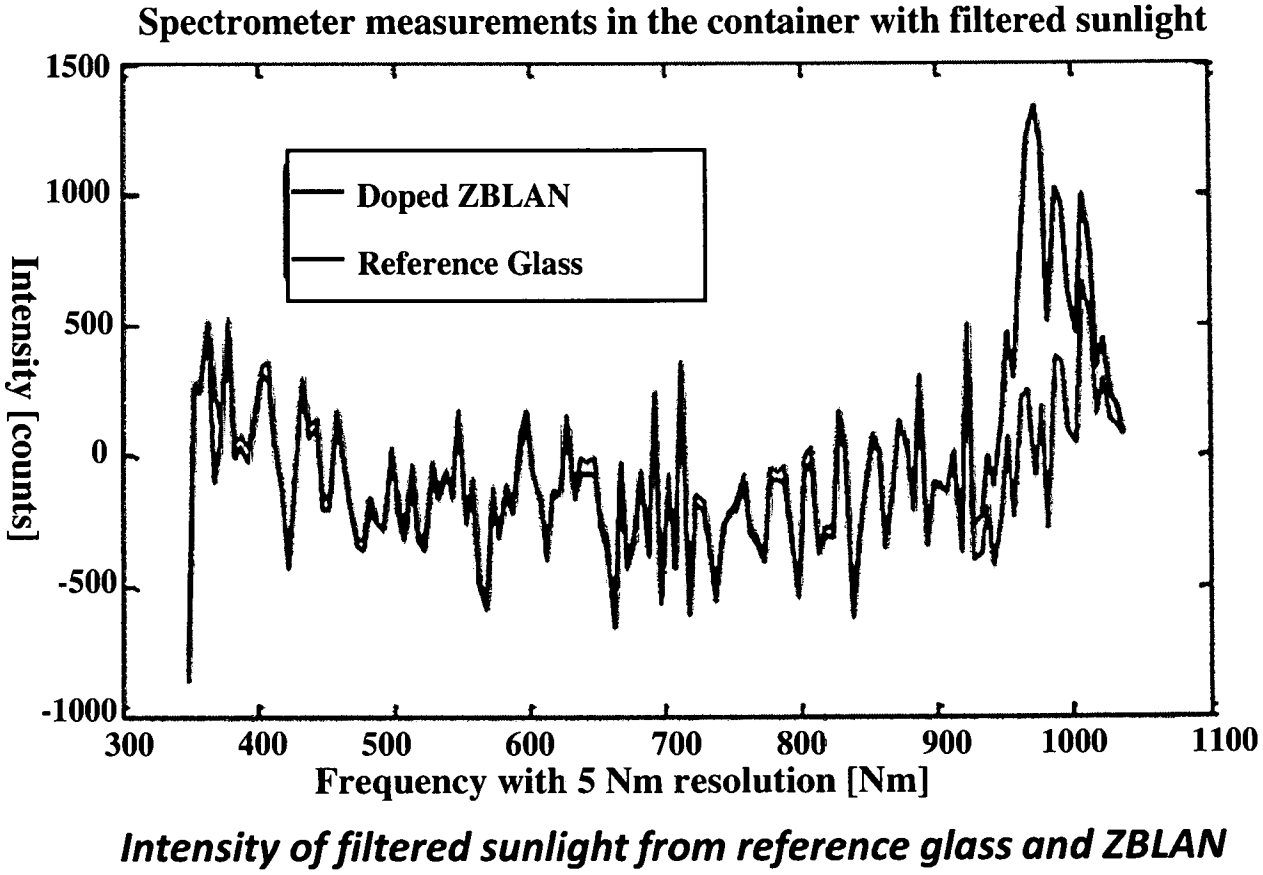
FIG. 12 shows the experimental results of the intensity of filtered sunlight from reference glass and ZBLN.

The experimental results shown in FIG. 12 are taken from the experiments with the spectrometer and the ZBLAN, which were used to estimate the cooling efficiency and equilibrium temperature of the ZBLAN. Using the filtered light of 1000-1030 nm, and the spectrometer, on the light reflected from a reference BK-7 glass and the ZBLAN we obtain the graph shown in FIG. 12.

The graph shown in FIG. 12 clearly indicates that the ZBLAN shows enhanced emission of light below 1000 nm, an indication that anti-Stokes scattering has taken place in the sample, cooling it. In the next step we estimated the cooling efficiency.

Cooling Efficiency Estimation

The total cooling efficiency is the product of the various efficiencies in the system. The expected cooling power is equal to:

(Sunlight simulator power)×(transmission of filter)×(fraction of radiation that undergoes anti-Stokes scattering)×(cooling efficiency of anti-Stokes)×(Other losses of radiation power)

Figure 13:
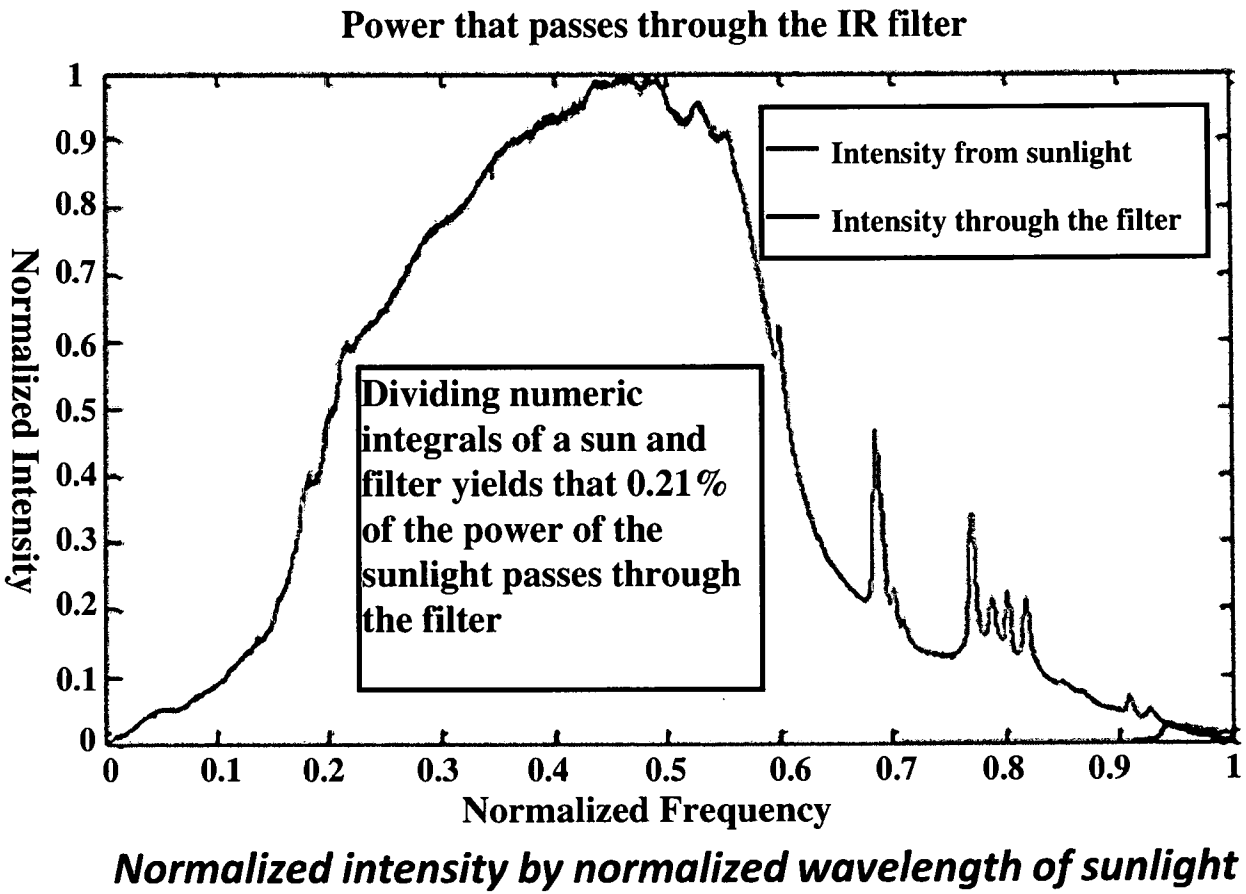
FIG. 13 shows the experimental results of the intensity normalized wavelength by sunlight simulator (upper curve) and trough the corresponding filter (lower curve).

The solar simulator power is 10 W. The filter transmits 0.21% of the total power of the sunlight simulator as shown in the graph of FIG. 13. In the upper curve in FIG. 13, we see the spectrum produced by the solar simulator. In lower curve we see the filtered spectrum.

Figure 14:
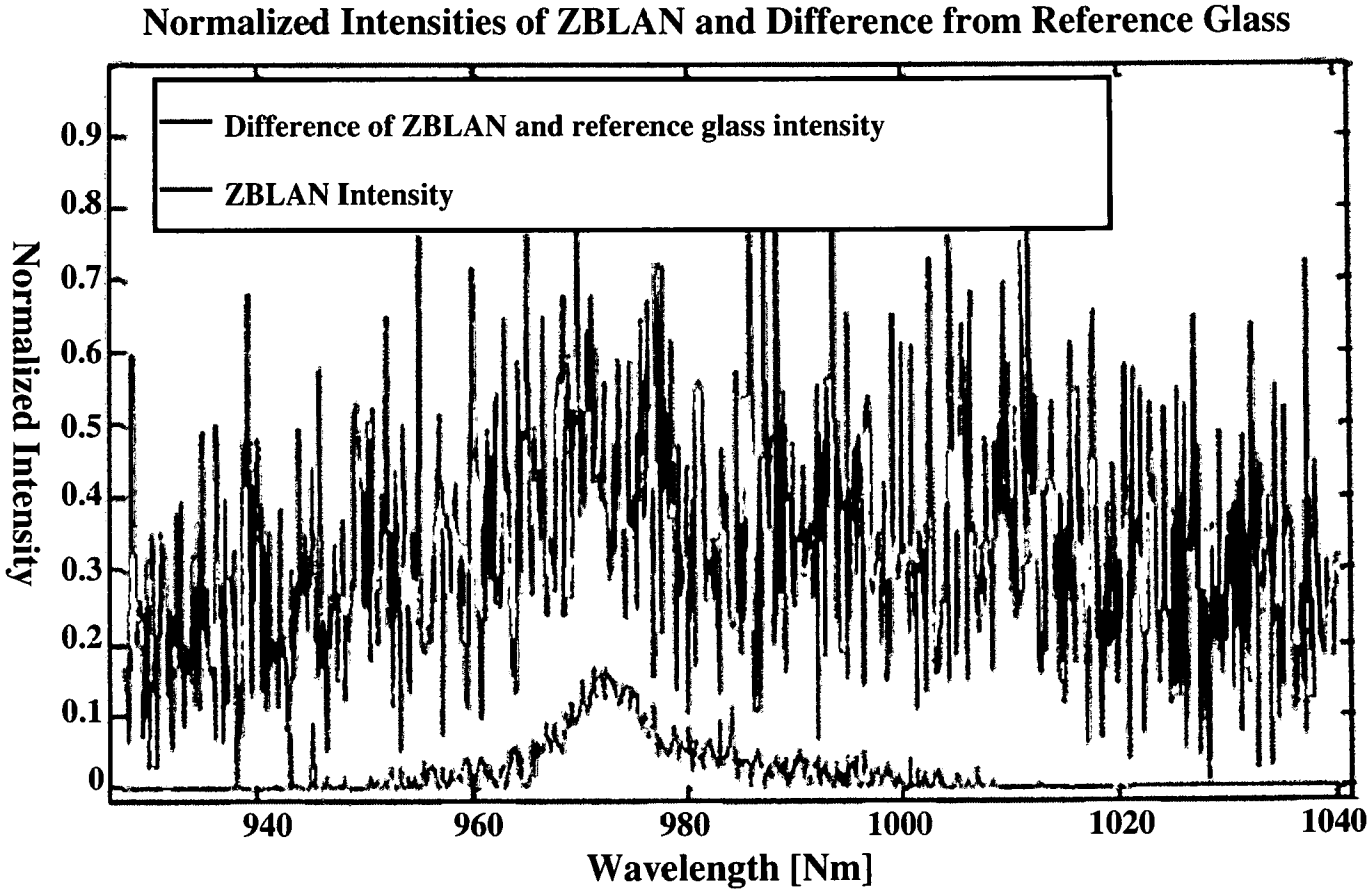
FIG. 14 shows the experimental results of the normalized intensities of ZBLN (upper curve) and differences from reference glass (lower curve).

In order to calculate how much of the radiation is anti-Stokes scattered we took the difference of the Intensity function of the ZBLAN and the same function of the reference glass, as shown in the graph of FIG. 14. From this graph, we calculated that 6% of the impinging radiation is anti-Stokes scattered.

Figure 15:
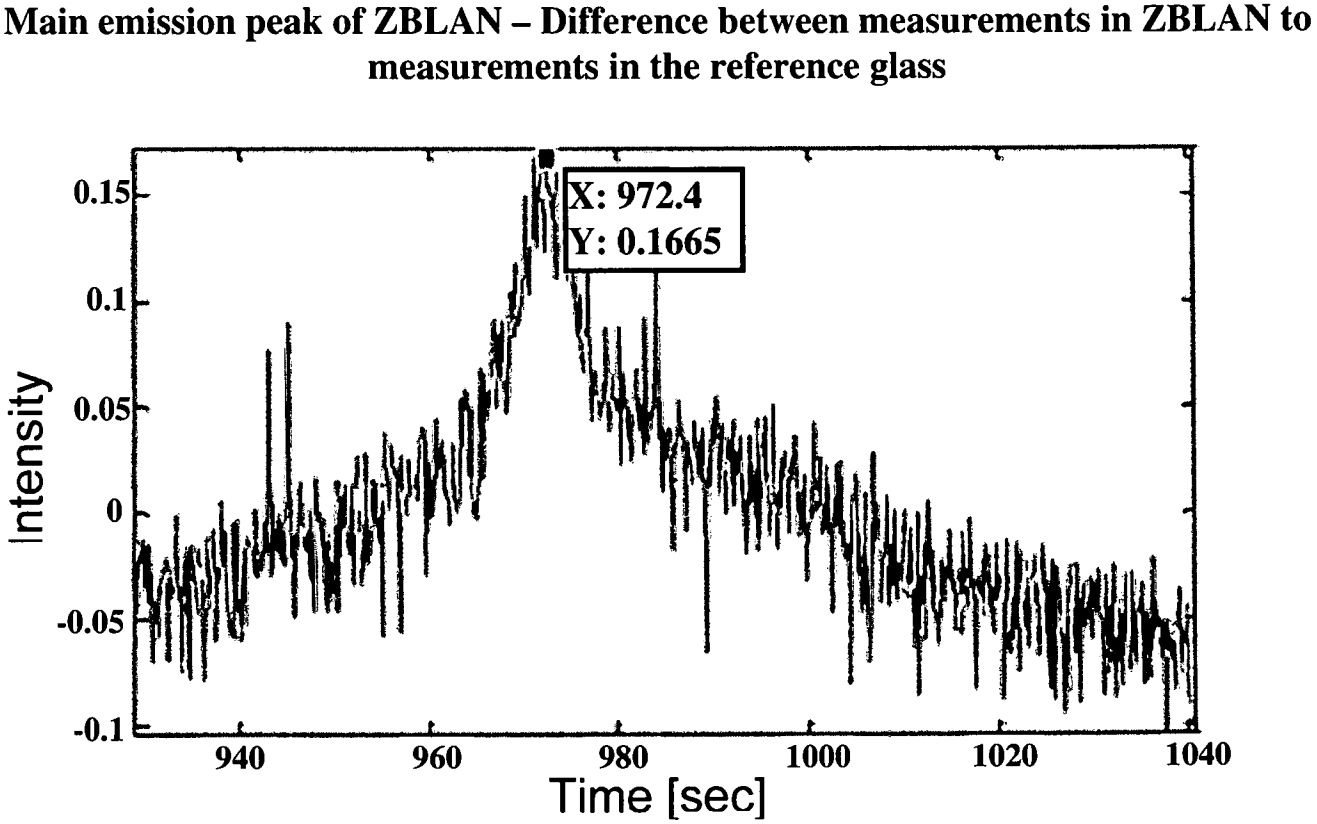
FIG. 15 experimental results intensity by wavelength of radiation of ZBLN of the difference between ZBLN and reference glass samples demonstrating the anti-Stokes scattering by ZBLN sample.

In a further step, we normalized and extracted the change in temperature of the ZBLAN sample. To this end, we considered that the energy of a photon is proportional to its wavelength. Hence, using that relation, the peak wavelength after the filter, considered as the peak of the input wavelength, was 1014 nm and the peak wavelength after the anti-Stokes scattering, considered as the peak of the input wavelength, was 972.4 nm which is, as shown in FIG. 15. Thus, we obtain 1−972.4/1014=0.04=4% of efficiency from the total power of the radiation that undergoes anti-Stokes scattering.

Other losses include light from the solar simulator that did not hit the lens, reflectance from filter, and more. We estimate those to be 0.5 of the total power. Giving $P_{cooling}$=10 W×0.5 (light losses)×0.06 (no resonance)×0.002 (amplitude after band pass)×0.04 (efficiency)=0.27mW. We can plug this number and L=(1.1*1.5*0.3/4.86)=0.1 cm=$10^{-3}$ m for our samples into the newton cooling equation, giving: $\Delta T=T0-0.03K+0.03K*e^{-bt}$, giving a final temperature of roughly 0.03° C., significantly below the uncertainty of the IR camera, and even below its thermal resolution. This required us to construct a system capable of temperature measurements with accuracy better than 1 mK.

Using Diodes to Measure the ZBLAN Sample Temperature

Experimental System

The system is similar to the one using the IR camera shown in FIG. 8, however the window (12) was removed and replaced with a vacuum feedthrough which included the wiring of two diodes for temperature measurement (not shown in the figure). One diode was attached to the sample with vacuum grease (Apiezon H) and the other was used as reference. The diode temperature was read out using an SRS diode temperature monitor (SIM922A).

Experimental Procedures

Experiments were performed with both the ZBLAN sample, and a reference glass of the same dimensions. The samples were first allowed to reach thermal equilibrium, before being irradiated with light from the solar simulator. Both filtered and unfiltered light was used. Testes were also run with different illumination angles and vacuum conditions.

Results and Discussion

Figure 16:
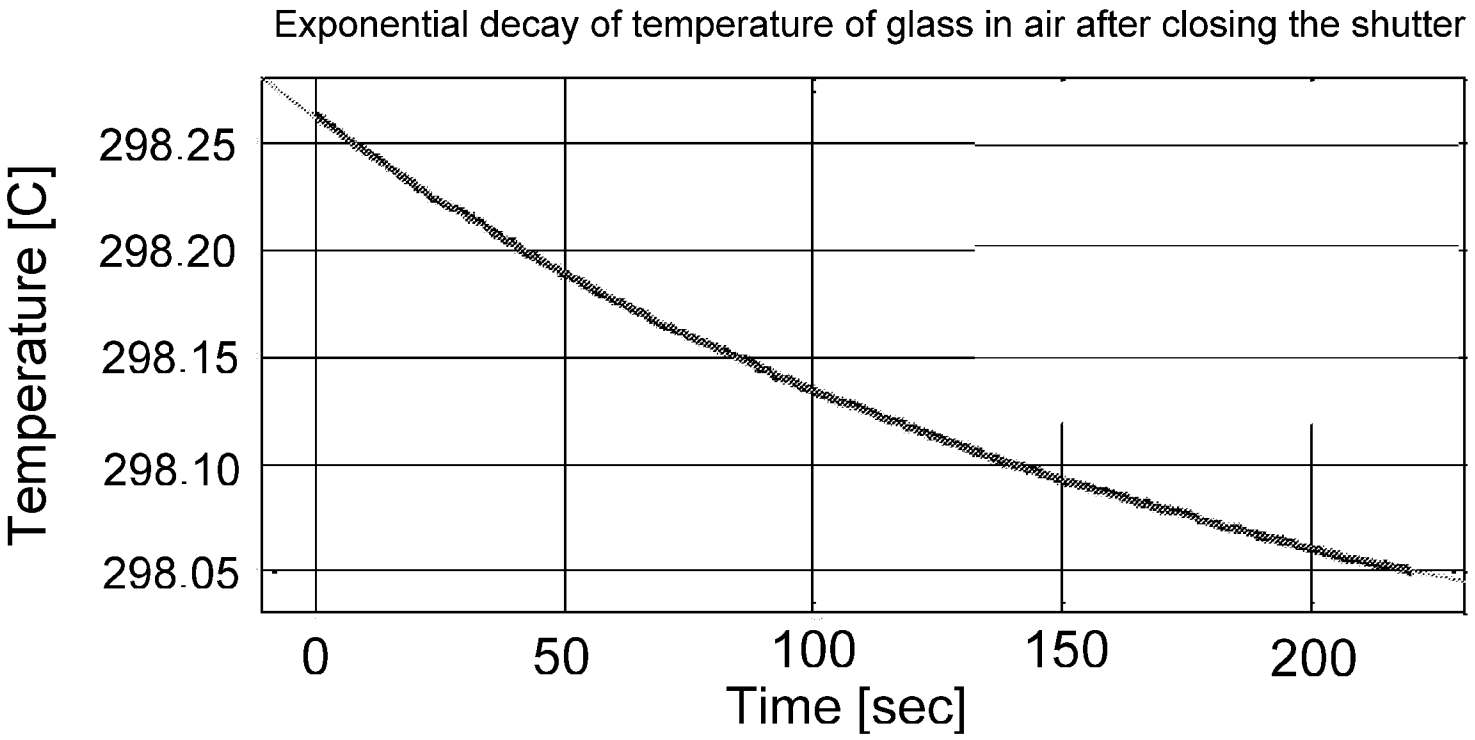
FIG. 16 shows exponential decay of the temperature with time of a glass in air after closing the shutter.

Most of the results showed very nice exponential temperature changes, as expected. All the samples tested showed heating when radiated with direct simulated sunlight or filtered light. After the shutter of the solar simulator was closed, all samples showed cooling back to ambient temperatures. The graph in FIG. 16 shows an exponential fit when the shutter was closed. The fit is the total change in temperature expected at infinite time (assuming exponential decay). b, is the b parameter in Newton's cooling equation, and is highly dependent on the material (in our fits we obtain values ranging from 0.006 to 0.0001. This range stems from differences in angle, location, and vacuum grease application procedures. The general model is presented in the following equation along with the values of its parameters and fit:

$$\frac{d(\Delta T)}{dt} = -P_{cooling} * \frac{1}{C} + b*(\Delta T)$$

$$C = \frac{1}{b} * L * k = \left[\frac{\mathrm{W}*s}{\mathrm{K}}\right]$$

$$\frac{\text{Volume}}{\text{Area}} = L = \text{effective length}$$

$$k = \text{constant of the material} = \frac{1\ \mathrm{W}}{\mathrm{K}*\mathrm{m}} \text{for glass}$$

$$\Delta T = T_0 - \frac{P_{cooling}}{L*k} + \frac{P_{cooling}}{L*k} * e^{-bt}$$

In order to compare the heating of the ZBLAN to the heating of the reference glass we compared the total change in temperature expected by opening the shutter and irradiating the samples. The total expected temperature change was not the same even under the same conditions. This is expected since the location, angle, greasing etc. of the sample has some effect on the heating. However, the results for filtered light and direct light were significantly different, as well as the results for air or vacuum. We used all the measurements with similar conditions in vacuum with filtered sunlight for ZBLAN, and for the reference glass and performed a two-sample t test on the two groups. All of the fits had a chi-squared value of between 0.5 and 2.5 with an uncertainty (sigma) of 0.0015° C. The groups of total temperature change upon illumination are: ZBLAN—0.031, 0.08855, 0.171, 0.0999, 0.035° C. and reference glass: 0.218, 0.152, 0.29, 0.05° C. The means are 0.09° C. for the ZBLAN and 0.18 for the reference glass. The P-value calculated is 0.063, which is below the binary threshold usually used for statistical significance (0.05). Yet there were only 9 measurements made in these conditions, therefore more experiments are needed to determine whether the ZBLAN sample is heated less than the reference sample. Regardless of the reference glass, since we have shown that anti-Stokes scattering occurs in the ZBLAN sample, the heating is probably caused by environmental and geometrical effects in the sample, thus, a better experimental system may allow for cooling to be observed.

CONCLUSIONS

Success Showing Anti-Stokes in Material Resulting in Cooling Effect

We found that the Yb:ZBLAN sample is heated by the simulated solar light, but on average is heated less than a reference sample. Since we observed anti-Stokes scattering from the Yb:ZBLAN sample, we believe conclude that active cooling below the environment temperature is achieveable. We found that the ZBLAN sample on average is heated less than a reference sample, and the difference is very close to be statistically significant. In addition, we observed anti-Stokes scattering from the ZBLAN sample—which shows a cooling power equivalent to 0.03 mW. To verify statistically our findings in these experiments, we used all the measurements with similar conditions in vacuum with filtered sunlight for ZBLAN, and for the reference glass and performed a two-sample t test on the two groups. All of the fits had a chi-squared value of between 0.5 and 2.5 with an uncertainty (sigma) of 0.0015° C. The groups of total temperature change upon illumination are: ZBLAN—0.031, 0.08855, 0.171, 0.0999, 0.035° C. and reference glass: 0.218, 0.152, 0.29, and 0.05. The means are 0.09 for the ZBLAN and 0.18 for the reference glass. The P-value calculated is 0.063, which is below the binary threshold usually used for statistical significance (0.05).

Yb:ZBLAN

As detailed, some promising results were achieved using Yb:ZBLAN glass. This indicates that some amount of cooling may be expected if using this material. In addition, Yb:ZBLAN is relatively easy to produce at a large scale, and its cooling does not depend on a specific morphology.

CdS

It is contemplated within the scope of the present invention that CdS nano-belts may be cooled by anti-Stokes scattering. Hence we conclude that under certain conditions a layer comprising CdS nano-belts can also be used and function as an active cooling anti-stock layer.

Recently, it was reported (Fontenot 2016) that successful cooling of CdSe/ZnS core shell quantum dots (QD) was accomplished using 647 nm laser radiation. Therefore, the other wavelengths may also be used for cooling different sized QDs. Additionally, the same authors demonstrated the successful incorporation of the aforementioned QDs into polymers.

Since QDs are, in principle, significantly easier to produce than CdS nano-belts, and indeed, are produced in bulk by several companies, and since the polymerization process is rather straightforward and lends itself easily to upscaling, it is within the scope of the present invention to obtain anti-Stokes solar cooling with polymers into which various core-shell quantum dots are incorporated. Particular material, which is suitable for application as QD is CdSe/ZnS.

Filter Top Layer and Bottom Layer Fabrication:

Experiment demonstrated a ZBLAN test samples as an active cooling without the top filter layer, where the later filtering layer has been replaced with filtering devices which performed experimentally the similar functionalities of this layer. As discussed above, the present invention provides a double- or multi-layer structure that filters the radiation spectrum and transmits only a selected band to the layer that displays anti-Stokes fluorescence. Thus, the top layer shields the bottom layer from unnecessarily absorbed radiation and actually renders the cooling effect more efficient by increasing the ratio of radiation output-input. Such double- or multi-layer structure filters a radiation spectrum by reflecting most of it back and away by the outer layer and transmitting a selected band of it to a second layer. The second layer in the invention absorbs the selected part of the spectrum, shifts it to a shorter wavelength range using anti-Stokes effect and emits it in a radiative manner As a result, a cooling effect is obtained. Practically there are various methods to fabricate such double or multi-layer device comprising of active and filtering layers. Such fabrication method relates to the specific scale the size of the cooling systems and devices including its integration into the specific particular embodiments of the present invention. The deposition of the active layer can be done above thick or thin Si, SOI wafers (Si Over Insulator), wafers and substrate wafers based on Ge substrate or Epi wafer based on III-V materials such as GaAs wafers. Si and SOI Wafers can be fabricated with low or high thermal and electrical resistance. Generally, in several embodiments of this invention, the previous substrate layers can be removed in a chemical and a or mechanical process, such as a grinding process done on the wafer or die back side after completion of processing the active cooling device composed of two or multi layer devices. This process can be done on wafer, die level or sample which contains array of devices or even on single device level. The second filtering layer can be mounted on, glued to, coated evaporated or deposited on or mechanically or chemically attached above the bottom active cooling layer. Such deposition method comprises Chemical Vapor Deposition (CVD) including low (LPCVD) and high (HPCVD) pressure, electrodeposition, Physical Vapor Deposition (PVD) and casting deposition methods, thermal oxidation, epitaxial growth, thermal oxidation deposition etc. In other embodiments, the active cooling layer can be deposited using the previous fabrication method above, which is based on Si,SOI, Ge, GaAs substrate and wafers.

Further, the success criteria for this process may be by evaluating the system active cooling efficiency via anti-Stokes scattering, however there are several design rules and guide lines which are recommended in this case:

i. For mechanical, chemical or thermal bonding, bonding is highly recommended to avoid creation of a buffer layer, residues of the bonding martial, air gaps or other unwanted residue layers between the bottom active cooling to the top filtering layer.

ii. The bonding between the layers should consider the thermal mechanical electrical and other stresses which can be applied on the system or device and degrade its performance. In this case, it is contemplated that environmental conditions of the device are considered such a humidity, temperature and electrical and magnetic inductances including DC and AC parasitic biases, iii. It is also contemplated within the scope of the present invention to a passivation layer, which is transparent to light radiation at the wavelength band and covers the system or device sensitive layers protecting the device top filtering and bottom anti-Stokes cooling layers and minimizing as much as possible their degradation over time. It is also contemplated that the cover layer isolates thermally and electrically the top and bottom layers of the device or system of the present invention. Further, it is contemplated that the cover layer protects the cooling device active layers from undesired environmental impacts, which can damage the active cooling layer properties and hence the system cooling properties. In further embodiment the at least one cover layer can be between the top and bottom layers or beneath the bottom layer.

The invention claimed is:

1. Apparatus for optical cooling of objects and/or object surfaces, said apparatus comprising:

at least one bottom layer, said bottom layer is configured to respond in anti- Stokes fluorescence upon absorption of electromagnetic radiation; and at least one top layer, said top layer is overlaid on said bottom layer and configured to filter said electromagnetic radiation and transmits selected spectral band of said electromagnetic radiation to said bottom layer;

wherein said electromagnetic radiation is incoherent non-monochromatic radiation with wide spectral band, wherein said selected spectral band is sufficient for excitation of electrons from ground energy state to excited energy state in active component in said bottom layer.

2. The apparatus according to claim 1, wherein said active component comprises at least one material selected from the group consisting of RE-ion doped materials, and crystalline semiconductor materials.

3. The apparatus according to claim 2, wherein said RE-ion is selected from Ytterbium in Ytterbium-doped yttrium lithium fluoride (Yb:YLF) crystal, Ytterbium in Ytterbium-doped tungstate crystal (Yb:KGW), 1 wt % $Yb^{3+}$ in fluorozirconate glass (ZBLANP) doped with $Yb^{3+}$, $9Be^{+}$ and Cesium.

4. The apparatus according to claim 2, wherein said semiconductor crystal or crystalline material is selected from CdS (Cadmium Sulfide), CdSe/ZnS, GaAs (Gallium Arsenide) and AlGaAs (Aluminum Gallium Arsenide).

5. The apparatus according to claim 4, wherein said CdS is provided as nano-belts, said nano-belts forming said bottom layer.

6. The apparatus according to claim 4, wherein said CdSe/ZnS is provided as Quantum Dots (QDs), said QDs forming said bottom layer.

7. The apparatus according to claim 1, wherein said at least one top layer is selected from Water, Aluminum Hydroxide, Calcium Carbonate, Titanium Dioxide, Zinc Oxide, Silica, Quartz, Chlorothalonil, Polysiloxanes, Nepheline Syenite, Titanium Dioxide, Silane, Methyl Ttri(ethylmethyl ketoxime), Octamethylcyclotetrasiloxane, Amorphous Silica, organic pigments, inorganic pigments, ceramic pigments, iron oxide, oxides, ceramic microspheres, propylene glycol, amorphous silica, naphta (hydrodesulfurized heavy petroleum), xylene, calcium carbonate, hydrocarbons, cyclo-alkanes and ethanol.

8. The apparatus according to claim 1, wherein said at least one bottom layer and at least top layer are provided in paint form.

9. The apparatus according to claim 1, wherein said apparatus is in the form of a double layer fiber, said at least one top layer is a shell of said fiber, said at least one bottom layer is core of said fiber.

10. The apparatus according to claim 9, wherein said double layer fiber is a textile fiber, said textile fiber is configured for making textiles for cooling covers and shields for objects and bodies.

11. The apparatus according to claim 10, wherein said covers and shields are selected from clothing, drapes, shades, curtains, bags, camping gear and food cooler covers.

12. The apparatus according to claim 1, wherein said object or object surface is selected from roof, wall, window, human body and food container.

13. The apparatus according to claim 1, wherein deposition of said at least one bottom layer at least one top layer is done on a substrate selected from thin Si, SOI substrate, wafer based Si or Ge substrate or Si or Ge epitaxial layers, wafer based on III-V group materials, wafers based on epitaxial layers of group III-V materials, wherein said Si and SOI Wafers are fabricated with low or high thermal and electrical resistance.

14. The apparatus according to claim 13, wherein said substrate is removable with chemical and/or mechanical process.

15. The apparatus according to claim 13, wherein said deposition is done on wafer, die level, a sample which contains array of devices or a single device level.

16. The apparatus according to claim 13, wherein said at least one top layer is deposited, processed and mounted, glued, coated, evaporated on, deposited or mechanically or chemically attached above said bottom active cooling layer.

17. The apparatus according to claim 13, wherein said deposition is selected from Chemical Vapor Deposition (CVD) including in low (LPCVD) and high (HPCVD) pressure, electrodeposition, Physical Vapor Deposition (PVD), casting deposition, thermal oxidation, epitaxial growth and thermal oxidation.

18. The apparatus according to claim 1, wherein said apparatus is fabricated with a buffer layer between said at least one bottom layer and said at least one top layer.

19. The apparatus according to claim 1 , wherein said apparatus is fabricated with a passivation layer, said passivation layer covering said apparatus or said at least one top layer, said passivation layer is configured to protect said top and or bottom layers layer physical, mechanical and electrical properties from physical, chemical or electrical damage, minimize its degradation over time and thermally and electrically isolate said bottom layers from environmental impacts.

20. The apparatus according to claim 1, wherein said apparatus is fabricated with a passivation layer, said passivation layer is deposited between said top layer and said at least one bottom layer, said passivation layer is configured to protect said top and or bottom layers layer physical, mechanical and electrical properties from physical, chemical or electrical damage, minimize its degradation over time and thermally and electrically isolate said bottom layers from environmental impacts.

* * * * *